US006477344B1

(12) United States Patent
Asakura et al.

(10) Patent No.: US 6,477,344 B1
(45) Date of Patent: Nov. 5, 2002

(54) IMAGE FORMING APPARATUS, TRANSFER BELT UNIT, CLEANING DEVICE AND CLEANER UNIT USED FOR IMAGE FORMING APPARATUS

(75) Inventors: Kenji Asakura, Osaka (JP); Yasutaka Tamai, Nara (JP); Masanori Yoshikawa, Osaka (JP); Noboru Katakabe, Kyoto (JP); Masawo Otsuka, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/576,282

(22) Filed: May 23, 2000

(30) Foreign Application Priority Data

May 28, 1999 (JP) ..... 11-149897
Jun. 23, 1999 (JP) ..... 11-177176

(51) Int. Cl.[7] ..... G03G 15/16
(52) U.S. Cl. ..... 399/101
(58) Field of Search ..... 399/101, 357, 399/102, 121, 302, 308, 349

(56) References Cited

U.S. PATENT DOCUMENTS 4,259,003 A * 3/1981 Mangal et al. ..... 399/129
4,588,279 A * 5/1986 Fukuchi et al. ..... 399/308
4,739,370 A * 4/1988 Yoshida et al. ..... 399/347
5,107,303 A 4/1992 Miyamoto et al.
5,148,227 A * 9/1992 Senba et al. ..... 399/349
5,343,277 A * 8/1994 Rooijakkers et al. ..... 399/101
5,469,247 A * 11/1995 Cheng et al. ..... 399/346
5,722,015 A * 2/1998 Tombs ..... 399/129
5,752,130 A 5/1998 Tanaka et al.
5,991,566 A * 11/1999 Tanaka et al. ..... 399/101
6,035,158 A * 3/2000 Asakura et al. ..... 399/101

FOREIGN PATENT DOCUMENTS

| | | | |
|---|---|---|---|
| EP | 684 532 | 11/1995 | |
| EP | 0 895 140 | 2/1999 | |
| GB | 2 294 007 | 4/1996 | |
| JP | 58-14173 | 1/1983 | |
| JP | 3-102384 | 4/1991 | |
| JP | 4-243290 | 8/1992 | |
| JP | 6-161288 | 6/1994 | |
| JP | 7-319356 | 12/1995 | |
| JP | 9-80934 | 3/1997 | |
| JP | 9-90840 | 4/1997 | |
| JP | 10-240028 A * | 9/1998 | ..... G03G/15/16 |

* cited by examiner

*Primary Examiner*—Robert Beatty
(74) *Attorney, Agent, or Firm*—Merchant & Gould P.C.

(57) ABSTRACT

An image forming apparatus capable of removing a toner remaining on the transfer belt (toner supporting member) with a simple configuration. The image forming apparatus includes an intermediate transfer belt that moves with charged toner supported on the surface thereof; a cleaner roller that is rotated while being pressed onto the intermediate transfer belt; a power source for supplying potential for electrically attracting the toner to the cleaner roller from the intermediate transfer belt; and a pretreatment roller that is pressed onto the intermediate transfer belt upstream from the cleaner roller in the moving direction of the intermediate transfer belt.

40 Claims, 13 Drawing Sheets

IMAGE FORMING APPARATUS, TRANSFER BELT UNIT, CLEANING DEVICE AND CLEANER UNIT USED FOR IMAGE FORMING APPARATUS

FIELD OF THE INVENTION

The present invention relates to monochrome and color image forming apparatus applicable as, for example, a printer, a copying machine, a facsimile, or the like, and to a transfer belt unit, a cleaning device, and a cleaner unit, which are used for the image forming apparatus.

BACKGROUND OF THE INVENTION

A conventional image forming apparatus, in particular, an image forming apparatus having a cleaning mechanism for removing toner remaining on a transfer belt is disclosed, for example, in JP 9-80934 A.

The image forming apparatus disclosed in the above-mentioned publication includes a charging member for charging waste toner remaining on the transfer belt after secondary transfer, and a collecting member for collecting the waste toner charged by the application of voltage. The apparatus is designed so that the charge of the waste toner on the transfer belt is equalized by applying a voltage to the charging member, and then the waste toner with the equalized charge is collected by the collecting member to which the voltage having a polarity opposite to the charge is applied.

Furthermore, a configuration using a cleaner roller is known as another conventional cleaning device having a cleaner for removing waste toner on the intermediate transfer belt or transfer belt. In this configuration, the voltage having a polarity opposite to the charging polarity of toner is applied to the cleaner, whereby the toner on the belt is removed. For example, JP 6-161288 A discloses a configuration using a metal roller as the cleaner roller.

The following is an explanation of this configuration with reference to FIG. 12. As shown in FIG. 12, a negatively charged toner image formed on a photosensitive member 201 is transferred onto a recording paper that is conveyed by the rotation of the transfer belt 202. The transfer belt 202 is rotated in the arrow direction in FIG. 12 and conveys the recording paper supporting a toner image to a winding portion at the supporting axis 203. The recording paper supporting a toner image is peeled off from the transfer belt 202 at the winding portion of the supporting axis 203 due to the stiffness of the recording paper, and then is conveyed to a fixing device (not shown) for further processing.

In this image forming process, besides the normal toner image, the toner of a residual image of a previous page, or toner fogging onto a region that is not in contact with the previous or subsequent recording pages is attached to the photosensitive member 201. Such a toner may contaminate the rear surface of the recording paper. A cleaner 204 removes such a waste toner.

This cleaner 204 includes a first metal cleaner roller 205 and a second metal cleaner roller 206 that is provided downstream from the first cleaner roller 205 in the rotation direction of the transfer belt 202. A voltage of −600V is applied to the first cleaner roller 205, and a voltage of +1000V is applied to the second cleaner roller 206. Then, the first cleaner roller 205 enhances the negative charge of the waste toner remaining on the transfer belt 202, and the second cleaner roller 206 removes the negatively charged waste toner remaining on the transfer belt 202. Moreover, the toner attached to the first and second cleaner rollers 206 and 206 is scraped off by a cleaning blade 207.

Furthermore, JP 7-319356 A discloses a configuration in which a metal roller and an elastic roller are combined. As shown in FIG. 13, this configuration uses a first cleaner roller 221 that is a metal roller arranged facing the photosensitive member 220 via a small gap and a second cleaner roller 222 that is pressed onto the photosensitive member 220 downstream from the first cleaner roller 221 in the rotation direction of the photosensitive member 220. The voltage having a polarity opposite to the charging polarity of the toner is applied to the first cleaner roller 221, whereby the waste toner on the photosensitive member 220 is adsorbed by the first cleaner roller 221. The second cleaner roller 222 removes the attached substances other than waste toner on the photosensitive member 220 by the force of the electric field and the mechanical shear force. The first and second cleaner rollers 221 and 222 are provided with a blade 224 for scraping off toner or attached substances on the surface of the cleaner rollers 221 and 222.

Furthermore, JP 9-90840 A discloses a configuration using a fur brush roller as a cleaner roller.

Furthermore, as a cleaning device for removing off waste toner on an intermediate transfer belt and a transfer belt, one having a configuration in which a rubber cleaning blade is pressed onto the surface of the belt so as to scrape off the waste toner is well known.

However, the above-mentioned conventional image forming apparatus disclosed in JP 9-80934 A, etc. has the following problems. First, in order to equalize the charge of the toner, a power source for high voltage is required. Furthermore, the surface of the transfer belt is chemically deteriorated since toner on the transfer belt is charged by minute discharge. Furthermore, since the voltage is applied to the charging member, a large amount of toner having an opposite polarity is attached onto the charging member, thus disturbing the charging by the minute discharge.

In the cleaning device, it is required to improve the cleaning performance for completely removing waste toner on the surface of the transfer belt or the intermediate transfer belt. In the conventional configuration using a metal roller shown in FIG. 12, the second cleaner roller 206 provided at the downstream in the rotation direction of the transfer belt 202 so as to be pressed onto the transfer belt 202, as well as the first cleaner roller 205 provided at the upper stream in the rotation direction of the transfer belt 202, provides the waste toner remained on the transfer belt 202 with opposite charges. Therefore, the waste toner remaining on the transfer belt 202 has the same polarity as that of the second cleaner roller 206, which makes it difficult to remove the waste toner remaining on the transfer belt 202 by the use of the second cleaner roller 206.

Furthermore, in the conventional configuration shown in FIG. 13, since the first cleaner roller 221 is arranged facing the photosensitive member 220 via a gap, it is not possible to remove sufficiently the waste toner on the photosensitive member 220. On the other hand, in the second cleaner roller 222, which is an elastic roller, provided downstream in the rotation direction of the photosensitive member 220 so as to be pressed onto the photosensitive member 220, the abrasion resistance is lower as compared with a metal roller, and the lifetime is short. Moreover, high accuracy cannot be secured, variation in the resistance due to the adsorbed moisture is large and furthermore the cost is high.

The conventional configuration in which a fur brush roller is used as a cleaner roller has the following problems: for example, the performance of removing toner is deteriorated because the fur lies flat after a long time of use; the resistance value is varied due to the absorbed moisture; the fur brush is clogged with toner; toner scatters by being blown away by the brush; toner is attached again onto the belt from the fur brush; and the like. Furthermore, a power source for a high voltage is required, and a fur brush itself is expensive, thus raising the cost as a whole.

Furthermore, in the configuration using a rubber cleaning blade, since the pressing power at the tip of the blade is large, the cleaning blade may damage the surface of the belt, and the cleaning blade may be deteriorated by abrasion. Furthermore, the load torque is increased by the friction force on a portion where the cleaning blade is in contact with and pressed onto the surface of the belt. When the cleaning blade is separated, toner accumulated at the tip of the blade scatters. When the cleaner unit is replaced with a new one, at the same time the tip of the blade is separated from the belt, the toner attached to the tip of the blade may drop off, and contaminate the inside and periphery of the apparatus.

SUMMARY OF THE INVENTION

It is an object of the present invention to provide an image forming apparatus capable of reliably removing waste toner on a toner supporting member of a transfer belt, and the like, with a simple configuration and to provide a transfer belt unit, a cleaning device and a cleaner unit, which are used for the image forming apparatus.

In order to attain the above-mentioned object, a first configuration of an image forming apparatus according to the present invention includes a toner supporting member that moves with charged toner supported on the surface thereof, a cleaner member that is rotated while being pressed onto the toner supporting member, a potential supplying means for supplying a potential for electrically attracting the toner from the toner supporting member to the cleaner member, and a frictionally charging member that is pressed onto the toner supporting member upstream from the cleaner member in the moving direction on the toner supporting member. According to the first configuration of the image forming apparatus, the toner remaining on the toner supporting member can be charged by friction with a normal polarity until the toner reaches the position of the cleaner member. Therefore, the waste toner on the toner supporting member can be cleaned off reliably by the cleaner member.

Furthermore, it is preferable in the configuration of the image forming apparatus according to the present invention that the toner supporting member is an intermediate transfer belt, and that there is provided a toner image forming means for forming a toner image charged with a predetermined polarity on the intermediate transfer belt, and a transfer means for transferring the toner image from the intermediate transfer belt onto a recording paper, wherein the cleaner member is pressed onto the intermediate transfer belt between the transfer means and the toner image forming means, and the frictionally charging member is positioned between the transfer means and the cleaner member. With such a preferred configuration, since the frictionally charging member is positioned between the transfer means and cleaner member, the toner remaining after transfer can be brought into contact with the frictionally charging member. Therefore, it is possible to remove positive charges from the toner at the same time, the toner can be charged negatively. The positive charges had been given at the time of transfer to the toner originally having negative polarity. Thus, toner carried to the cleaner portion assumes the normal polarity. As a result, it is possible to remove the remaining toner by a cleaner member to which positive voltage is applied. Furthermore, by employing such a configuration, the waste toner can be removed with a much lower cleaning voltage. Lowering the cleaning voltage makes it possible to suppress the load variation due to the cleaner member, thus suppressing the displacement of the cleaner member when the cleaner member is separated. Furthermore, in this case, it is preferable that the frictionally charging member is a rotatable roller, and the transfer means is a transfer roller to which a voltage is applied while switching between a voltage with a polarity opposite to the charging polarity of the toner and a voltage with a polarity the same as the charging polarity of the toner. The voltage having the same polarity as the charging polarity of the toner is applied to the transfer roller, then the voltage having a polarity opposite to the charging polarity of the toner while allowing the frictionally charging member to be rotated at least once. In order to clean off the transfer roller, an opposite voltage is applied to the transfer roller. At this time, a large amount of toners on the intermediate transfer belt are attached to the frictionally charging member, thereby making it impossible to be in contact with toner on the intermediate transfer belt. In this case, when the voltage having the same polarity as the charging polarity of the toner is applied to the transfer roller, then the voltage having the opposite polarity to the charging polarity of the toner, and in this state, the frictionally charging member is allowed to be rotated at least once, the toners attached to the frictionally charging member are attached to the intermediate transfer belt. Therefore, the frictionally charging member can be in contact with the toner on the intermediate transfer belt again.

Furthermore, it is preferable in the first configuration of the image forming apparatus according to the present invention that the toner supporting member is a transfer belt for conveying a recording paper and that there are provided a toner image forming means for forming a toner image charged with a predetermined polarity on the recording paper, a peeling means for peeling the recording paper from the transfer belt, wherein the cleaner member is pressed onto the transfer belt between the peeling means and the toner image forming means, and the frictionally charging member is positioned between the peeling means and the cleaner member. With such a preferred configuration, since the frictionally charging member is positioned between the peeling means and the cleaner member, the toner remaining after transfer can be brought into contact with the frictionally charging member. Therefore, it is possible to remove positive charges from the toner at the same time, the toner can be charged negatively. The positive charges are given at the time of transfer to the toner originally having negative polarity. Thus, toner carried to the cleaner portion comes to have the normal polarity. As a result, it is possible to remove the remaining toner by a cleaner member to which positive voltage is applied. Furthermore, by employing such a configuration, the waste toner can be removed with a much lower cleaning voltage. Lowering the cleaning voltage makes it possible to suppress the load variation due to the cleaner member, thus suppressing the displacement of the cleaner member when the cleaner member is separated.

Furthermore, it is preferable in the first configuration of the image forming apparatus according to the present invention that the frictionally charging member is electrically grounded. With such a preferred configuration, since toner is not attached excessively to the frictionally charging member, a stable transfer of charges can be performed because the frictionally charging member can be in contact with toner on the toner supporting member. Furthermore, since no minute discharge occurs between the frictionally charging member and toner supporting member, the surface of the toner supporting member is not deteriorated. Furthermore, even if the semiconductive belt is used as the toner supporting member, it does not affect the conditions of secondary transfer or primary transfer. Furthermore, it is possible to break the wraparound of electric current from the cleaner member and thus to prevent the cleaner member from affecting the process conditions of other members.

Furthermore, it is preferable in the first configuration of the image forming apparatus according to the present invention that the surface of the frictionally charging member has a charging polarity opposite to that of the toner. With such a preferred configuration, when the frictionally charging member is in contact with toner, a larger amount of positive charges on the surface of toner can be removed by only one touch, and therefore waste toner on the toner supporting member can be removed completely.

Furthermore, it is preferable in the first configuration of the image forming apparatus according to the present invention that the frictionally charging member is a rotatable roller that is in contact only with the toner supporting member, and the frictionally charging member and the toner supporting member move at different speeds from each other at the contact portion therebetween. With such a preferred configuration, toner on the toner supporting member can be provided with both electric attraction force and mechanical shear force. Therefore, the waste toner on the toner supporting member can be removed completely. Furthermore, since there is not provided members for scraping off the toner on the surface of the frictionally charging member, it is possible to simplify the configuration around the frictionally charging member.

Furthermore, it is preferable in the first configuration of the image forming apparatus according to the present invention that the frictionally charging member is a rotatable roller that is in contact only with the toner supporting member, and the frictionally charging member and the toner supporting member move in the same direction at the contact portion therebetween. With such a preferred configuration, the toner attached to the frictionally charging member is allowed to pass through the nip portion between the toner supporting member and the frictionally charging member. Therefore, since the opportunity that the frictionally charging member is brought into contact with toner, it is possible to remove a larger amount of positive charges on the surface of the toner by the frictionally charging member. As a result, the waste toner on the toner supporting member can be removed completely.

Furthermore, it is preferable in the first configuration of the image forming apparatus according to the present invention that the frictionally charging member is separable from the toner supporting member, and a driving force is transmitted from a driving portion of the toner supporting member to the frictionally charging member. With such a preferred configuration, even when the frictionally charging member is separated, the driving force can be transmitted stably from the driving portion of the toner supporting member to the frictionally charging member.

Furthermore, it is preferable in the first configuration of the image forming apparatus according to the present invention that an opposing electrode is provided at a position facing the frictionally charging member while sandwiching the toner supporting member between the opposing electrode and the frictionally charging member. With such a preferred configuration, it is possible to increase the contact pressure between the frictionally charging member and the toner on the toner supporting member. Therefore, it is possible to smoothen an unevenness of the toner layer so that a larger amount of toner can be brought into contact with the frictionally charging member. At the same time, it is possible to increase the true area of contact when the frictionally charging member is brought into contact with the toner. As a result, there is an increased opportunity that the frictionally charging member is in contact with toner, whereby a larger amount of positive charges can be removed from the surface of the toner by only one touch. Therefore, it is possible to remove the waste toner on the toner supporting member by the cleaner member. Furthermore, in this case, it is preferable that the frictionally charging member is electrically grounded, and the opposing electrode and the cleaner member have the same potential. With such a preferred configuration, an electric field is generated on the portion in which the frictionally charging member is in contact with the toner on the toner supporting member. This electric field allows positive charges to move in the direction toward the frictionally charging, and negative charges to move in the direction toward the toner. Therefore, when the frictionally charging member is in contact with toner, it is possible to remove a larger amount of positive charges on the toner by only one touch. At the same time, the toner can be changed negatively. Moreover, since a plurality of members are made to have the same potential, it is not necessary to provide an additional electric power source or terminal, thus realizing a simple and low-price configuration of the apparatus. Furthermore in this case, it is preferable that the opposing electrode is made of a conductive brush. With such a preferred configuration, a cleaning electric field can be formed stably over the entire region of the cleaning nip. Since the cleaning field can be formed stably, it is possible to improve the performance of cleaning off toner on the intermediate transfer belt. As a result, even if the cleaning voltage is set low, it is possible to remove the waste toner completely and stably. Furthermore, by using the opposing electrode, it is possible to press the toner supporting member onto the cleaner member over the entire region of the cleaning nip. Therefore, even if there is a distortion or deformation in the toner supporting member, it is possible to secure the stable cleaning nip. Consequently, it is possible to secure both the friction force and electric field force, which are applied to the toner on the toner supporting member. Thus, the sufficient cleaning performance can be exhibited, and the waste toner can be removed stably and completely.

Furthermore, it is preferable in the first configuration of the image forming apparatus according to the present invention that the frictionally charging member is a rotatable roller having a surface roughness Ra of 5–20 $\mu$m. With such a preferred configuration, since the mechanical shear force applied to the toner on the toner supporting member is increased, aggregated toner can be pulverized. Therefore, it is possible to prevent the aggregated toner from deforming the toner supporting member. Therefore, it is possible to bring the toner in the vicinity of the aggregated toner into contact with the frictionally charging member and the cleaner member. Thus, the toner can be removed more completely. Furthermore, in this case, it is preferable that the surface of the frictionally charging member is subjected to a sand-blasting procedure.

Furthermore, it is preferable in the image forming apparatus of the first configuration according to the present invention that the cleaner member is an aluminum roller having an alumite layer on the surface thereof, comprising a scraper for removing the toner while being pressed onto the surface of the cleaner member.

Furthermore, a first configuration of a transfer belt unit according to the present invention includes as an integrated unit; a high resistance intermediate transfer belt which is supported rotatably, and on which toner charged with a predetermined polarity is transferred to a toner image by primary transfer, and further the toner image is transferred onto a recording paper by secondary transfer; a cleaner roller which is pressed onto the intermediate transfer belt downstream from the secondary transfer position in the rotation direction of the intermediate transfer belt and to which a voltage with a polarity opposite to the predetermined polarity of the toner is applied; a frictionally charging member that is pressed onto the intermediate transfer belt between the secondary transfer position and the cleaner roller, wherein the integrated unit is attached to a main body of the image forming apparatus detachably. According to the first configuration of the transfer belt unit, when the transfer belt unit is replaced with new one, it is possible to eject the waste toner to the outside of the apparatus without spilling of toner at the time of the replacement of the intermediate transfer belt. Therefore, by integrating the members into one unit, maintenance can be performed easily without contaminating the inside of the image forming apparatus main body with the waste toner. Furthermore, integrated configuration makes it possible to maintain the accuracy of the positional relationship between the intermediate transfer belt and the cleaner roller to the predetermined value easily. Therefore, it is possible to keep the image forming apparatus main body in good condition for a long time with only simple maintenance.

Furthermore, it is preferable in the first configuration of the transfer belt unit according to the present invention that the frictionally charging member is electrically grounded.

Furthermore, it is preferable in the first configuration of the transfer belt unit according to the present invention that the surface of the frictionally charging member has a charging polarity opposite to the charging polarity of the toner.

Furthermore, it is preferable in the first configuration of the transfer belt unit according to the present invention that the frictionally charging member is a rotatable roller that is in contact only with the toner supporting member, and the frictionally charging member and the toner supporting member move at different speeds from each other at the contact portion therebetween.

Furthermore, it is preferable in the first configuration of the transfer belt unit according to the present invention that the frictionally charging member is a rotatable roller that is in contact only with the toner supporting member, and the frictionally charging member and the toner supporting member move in the same direction at the contact portion therebetween.

Furthermore, it is preferable that the first configuration of the transfer belt unit according to the present invention includes a driving axis for rotating the intermediate transfer belt suspended therefrom, a disjunction means for separating the frictionally charging member from the intermediate transfer belt, and a driving force transmitting means for transmitting a driving force from the driving axis to the frictionally charging member.

Furthermore, it is preferable in the first configuration of the transfer belt unit according to the present invention that an opposing electrode is provided at a position facing the frictionally charging member while sandwiching the intermediate transfer belt between the opposing electrode and the frictionally charging member. Furthermore, in this case, it is preferable that the opposing electrode and the cleaner roller have the same potential.

Furthermore, it is preferable in the first configuration of the transfer belt unit according to the present invention that the frictionally charging member is a rotatable roller, having a surface roughness Ra of 5–20 $\mu$m. Furthermore, in this case, it is preferable that the surface of the frictionally charging member is subjected to a sand-blasting procedure.

Furthermore, it is preferable in the first configuration of the transfer belt unit according to the present invention that the cleaner roller is an aluminum roller, having an alumite layer on the surface thereof, and that there is provided a scraper for removing the toner while being pressed onto the surface of the cleaner roller.

Furthermore, a second configuration of an image forming apparatus according to the present invention includes a toner supporting member that moves with charged toner supported on the surface thereof, a cleaner member that is rotated while being pressed onto the toner supporting member, and a potential supplying means for supplying potential for electrically attracting the toner from the toner supporting member to the cleaner member, wherein the cleaner member is made of metal and has a high-resistance layer on the surface thereof. According to the second configuration of the image forming apparatus, no charges are accumulated on the surface of the cleaner member. Moreover, charges opposite to the charging polarity of the toner are not provided onto the cleaner member. Furthermore, the surface of the cleaner member has an excellent abrasion resistance property and the shape is not changed. Furthermore, as compared with the configuration in which the fur brush is used, a cleaner member is low-price and can be formed in a simple configuration. Therefore, it is possible to obtain a high quality image stably for a long time with a simple configuration.

Furthermore, it is preferable in the second configuration of the image forming apparatus according to the present invention that the toner supporting member is an intermediate transfer belt and that there are provided a toner image forming means for forming a toner image charged with a predetermined polarity on the intermediate transfer belt, and a transfer means for transferring the toner image from the intermediate transfer belt onto a recording paper, wherein the cleaner member is pressed onto the intermediate transfer belt between the transfer means and the toner image forming means. Furthermore, in this case, it is preferable that a first opposing electrode is provided at a position facing the cleaner member while sandwiching the intermediate transfer belt between the first opposing electrode and the cleaner member. With such a preferred configuration, over the entire region of the cleaning nip of the cleaner member, it is possible to form the stable cleaning electric field for attracting the toner toward the cleaner member. Furthermore, in this case, it is preferable that the image forming apparatus includes a conductive pretreatment member which is electrically grounded and is pressed onto the intermediate transfer belt between the transfer means and the cleaner member. With such a preferred configuration, it is possible to remove the opposite charge given to toner at the time of secondary transfer and at the same time, the toner can be charged normally. As a result, it is possible to remove the toner remaining after the secondary transfer with a cleaner member at lower voltage. Furthermore, in this case, it is preferable that the pretreatment member is a rotatable roller that is in contact only with the intermediate transfer belt, and the pretreatment member and the intermediate transfer belt move at different speeds from each other at the contact portion therebetween. With such a preferred configuration, since toner can roll at the portion in which the pretreatment member is in the contact with the intermediate transfer belt, the contact opportunity between the pretreatment member and toner is increased. As a result, a larger amount of the opposite charges on the surface of the toner can be removed in advance. In this case, it is furthermore preferable that the pretreatment member is a rotatable roller that is in contact only with the intermediate transfer belt, and the pretreatment member and the intermediate transfer belt move in the same direction at the contact portion therebetween. With such a preferred configuration, since toner can roll at the portion in which the pretreatment member is in contact with the intermediate transfer belt, the contact opportunity between the pretreatment member and toner is increased. As a result, a large amount of opposite charges on the surface of the toner can be removed by the pretreatment member. In this case, since a member for scraping off the toner on the surface of the pretreatment member is not provided, the configuration around the pretreatment member can be simplified. In this case, it is further preferable that a second opposing electrode is provided at a position facing the pretreatment member while sandwiching the intermediate transfer belt between the second opposing electrode and the pretreatment member. With such a preferred configuration, since the contact opportunity in which the pretreatment member is in contact with the toner is increased, it is possible to remove the waste toner completely by the cleaner member. Furthermore, in this case, it is preferable that the second opposing electrode and the cleaner member have the same potential. With such a preferred configuration, an electric field is generated on the portion in which the pretreatment member is in contact with the toner on the intermediate transfer belt, it is possible to remove a larger amount of opposite charges on the surface of the toner by only one touch, and at the same time, the toner can be charged normally. Moreover, since a plurality of members are made to have the same potential, it is not necessary to provide an additional electric power source or terminal, thus realizing the apparatus configuration simply and at low cost. Furthermore, in this case, it is preferable that the cleaner member is separable from the intermediate transfer belt. With such a preferred configuration, since a toner image is not disturbed due to the cleaner member, it is possible to overlap toner images by rotating the intermediate transfer belt several times. Thus, it is possible to provide a whole apparatus having a small size at low cost. In this case, it is further preferable that a first conductive brush that is electrically grounded is provided at a position facing the cleaner member while sandwiching the intermediate transfer belt between the first conductive brush and the cleaner member. With such a preferred configuration, load variation when the cleaner member is separated can be suppressed. As a result, a high quality image can be obtained by suppressing the displacement of each toner image. Furthermore, in this case, it is preferable that the image forming apparatus includes a pretreatment roller that is electrically grounded and is pressed onto the intermediate transfer belt between the transfer means and the cleaner member, and a pretreatment roller disjunction mechanism for separating the pretreatment roller from the intermediate transfer belt. Furthermore, it is preferable that a second conductive brush having the same potential as that of the cleaner member is provided at a position facing the pretreatment roller while sandwiching the intermediate transfer belt between the second conductive brush and the pretreatment roller. In this case, it is preferable that an absolute value of the voltage applied to the cleaner member is 150–400V.

Furthermore, it is preferable in the second configuration of an image forming apparatus according to the present invention that the toner supporting member is a transfer belt for conveying a recording paper, and that there are provided a toner image forming means for forming a toner image charged with a predetermined polarity on the recording paper, and a peeling means for peeling the recording paper from the transfer belt, wherein the cleaner member is pressed onto the transfer belt between the peeling means and the toner image forming means. Furthermore, in this case, it is preferable that a first opposing electrode is provided at a position facing the cleaner member while sandwiching the intermediate transfer belt between the first opposing electrode and the cleaner member. Furthermore, in this case, it is preferable that the image forming apparatus includes a conductive pretreatment member that is electrically grounded and is pressed onto the intermediate transfer belt between the peeling means and the cleaner member. Furthermore, in this case, it is preferable that a second opposing electrode is provided at a position facing the pretreatment member while sandwiching the transfer belt between the second opposing electrode and the pretreatment member. Furthermore, in this case, it is preferable that the second opposing electrode and the cleaner member have the same potential.

Furthermore, it is preferable in the second configuration of an image forming apparatus according to the present invention that the toner supporting member has a surface resistivity of $1\times10^{8}$ Ω/□ or more and $1\times10^{10}$ Ω/□ or less, and a volume resistivity of $1\times10^{8}$ Ω·cm or more and $1\times10^{10}$ Ω·cm or less.

Furthermore, it is preferable in the second configuration of an image forming apparatus according to the present invention that the cleaner member has an anodic oxidation coating on the surface thereof. Furthermore, in this case, it is preferable that the cleaner member is made of aluminum, having an alumite layer on the surface thereof.

Furthermore, it is preferable that the second configuration of an image forming apparatus according to the present invention includes a scraper for scraping off the toner by being pressed onto the surface of the cleaner member. With such a preferred configuration, it is possible to obtain a high quality image for a long time with an apparatus of simple configuration at low price. Furthermore, in this case, it is preferable that the scraper is a thin metal plate having a thickness of 30–80 μm. Furthermore, in this case, it is preferable that a lubricant is attached to the surface of the cleaner member. With such a preferred configuration, since the frictional coefficient between the cleaner member and the scraper is reduced. The abrasion of the scraper can be reduced. Furthermore, since the force of the cleaner member to carry toners is reduced, the toner can be scraped off easily by the scraper. As a result, it is possible to obtain a high quality image stably for a long time. Furthermore, in this case, it is preferable that the surface roughness $R_{max}$ of the cleaner member is 0.5–8 μm.

Furthermore, it is preferable in the second configuration of the image forming apparatus according to the present invention that the cleaner member and the toner supporting member move at different speeds from each other at a contact portion therebetween. With such a preferred configuration, the toner on the toner supporting member can be provided with both an electric attraction force and mechanical shear force simultaneously. Therefore, the waste toner on the toner supporting member can be removed completely. As a result, it is possible to obtain a high quality image stably.

Furthermore, it is preferable in the second configuration of the image forming apparatus according to the present invention that the cleaner member and the toner supporting member move in opposite directions at a contact portion therebetween. With such a preferred configuration, toner on the toner supporting member can be provided with a mechanical shear force without increasing the peripheral speed. As a result, it is possible to increase the lifetime of the cleaner member and at the same time to suppress the energy consumption by the rotation of the cleaner member.

Furthermore, a second configuration of a transfer belt unit according to the present invention includes an intermediate transfer belt that is supported rotatably, and on which toner charged with a predetermined polarity is transferred to a toner image by primary transfer, and further the toner image is transferred onto a recording paper by secondary transfer; a cleaner roller made of metal and having a high resistance layer on the surface thereof, which is rotated while being pressed onto the intermediate transfer belt downstream from the secondary transfer position in the rotation direction of the intermediate transfer belt; a potential supplying means for supplying a potential for electrically attracting the toner to the cleaner roller; and a scraper for scraping off the toner while being pressed onto the surface of the cleaner roller; wherein the integrated unit is attached to a main body of the image forming apparatus detachably. According to the second configuration of the transfer belt unit, when the transfer belt unit is replaced with a new one, when the intermediate transfer belt is replaced with a new one, the waste toner can be ejected without spilling toner. Therefore, maintenance can be performed easily without contaminating the inside of the image forming apparatus main body with the waste toner. Furthermore, since the intermediate transfer belt, the cleaner roller and scraper are integrated into one unit, it is possible to maintain the accuracy of positional relationship between such integrated members and the whole apparatus. Therefore, it is possible to keep the apparatus main body in good condition for a long time with only simple maintenance. Moreover, charges are not accumulated on the surface of the cleaner roller, and furthermore, the toner is not provided with charges of the opposite polarity to the charging polarity. Furthermore, the surface of the cleaner roller has an excellent abrasion resistance property and the shape of the roller is not changed. Furthermore, as compared with the configuration in which the fur brush is used, the cleaner roller is inexpensive and the configuration is simple. As a result, with such a configuration, cleaning can be performed for a long time stably. Furthermore, the lifetime of the transfer belt unit is increased, and thus the frequency of the maintenance is reduced. Consequently, the cost per paper can be reduced and at the same time, the apparatus can be used more easily. Furthermore, in this case, it is preferable that the intermediate transfer belt has a surface resistivity of $1\times10^{8}$ Ω/□ or more and $1\times10^{10}$ Ω/□ or less, and a volume resistivity of $1\times10^{8}$ Ω·cm or more and $1\times10^{10}$ Ω·cm or less. Furthermore, in this case, it is preferable that the cleaner roller has an anodic oxidation coating on the surface thereof. With such a preferred configuration, on the surface of the cleaner roller, a layer having a high hardness and high electric resistance can be formed easily. As a result, the increased lifetime of the transfer belt unit and low-price configuration of the transfer belt unit can be realized. Furthermore, in this case, it is preferable that the cleaner roller is made of aluminum, having an alumite layer on the surface thereof. Furthermore, in this case, it is preferable that the scraper is a thin metal plate having a thickness of 30–80 μm. With such a preferred embodiment, the abrasion resistance of the scraper can be enhanced, and the lifetime of the transfer belt unit can be increased. Furthermore, in this case, it is preferable that a lubricant is attached to the surface of the cleaner roller. With such a preferred embodiment, it is possible to scrape off the toner with the scraper for a long time. Consequently, the long lifetime of the transfer belt unit can be attained. Furthermore, in this case, it is preferable that the surface roughness $R_{max}$ of the cleaner roller is 0.5–8 μm. Furthermore, in this case, it is preferable that the cleaner roller and the intermediate transfer belt move at different speeds from each other at a contact portion therebetween. With such a preferred configuration, the toner on the intermediate transfer belt can be provided with both an electric attraction force and a mechanical shear force. Therefore, the waste toner on the intermediate transfer belt can be removed completely. Furthermore, in this case, it is preferable that the cleaner roller and the intermediate transfer belt move in the opposite direction at a contact portion therebetween. With such a preferred configuration, the toner on the intermediate transfer belt can be provided with mechanical shear force without increasing the peripheral speed. As a result, the speed in which the scraper and cleaner roller are in contact and scrape with each other is reduced, and thus it is possible to scrape off the toner stably with the scraper for a long time. Therefore, the lifetime of the transfer belt unit can be increased.

Furthermore, in this case, it is preferable that a first opposing electrode is provided at a portion facing the cleaner roller while sandwiching the intermediate transfer belt between the first opposing electrode and the cleaner roller. With such a preferred configuration, a cleaning electric field for attracting toner toward the cleaner roller can be formed stably over the entire region of the cleaning nip. Furthermore, in this case, it is preferable that there is provided a conductive pretreatment member that is electrically grounded and is pressed onto the intermediate transfer belt between the second transfer position and the cleaner roller. With such a preferred configuration, it is possible to remove an opposite charge given from the toner at the time of secondary transfer, and at the same time, the toner can be charged normally. As a result, it is possible to remove the toner remaining after the second transfer by the cleaner member of lower voltage. Furthermore, in this case, it is preferable that the pretreatment member is a rotatable roller that is in contact only with the intermediate transfer belt, and the pretreatment member and the intermediate transfer belt move at different speeds from each other at the contact portion therebetween. With such a preferred configuration, since toner can roll on the portion in which the pretreatment member is in contact with the intermediate transfer belt, the contact opportunity between the pretreatment member and toner is increased. As a result, a larger amount of opposite charges on the surface of toner can be removed in advance. Furthermore, in this case, it is preferable that the pretreatment member is a rotatable roller that is in contact only with the intermediate transfer belt, and the pretreatment member and the intermediate transfer belt move in the same direction at the contact portion therebetween. With such a preferred configuration, the toner attached to the pretreatment member is allowed to pass through the nip to the intermediate transfer belt. Therefore, since the opportunity that the pretreatment member is brought into contact with the toner increases, it is possible to remove a larger amount of positive charges on the surface of the toner by the pretreatment member. In this case, a member for scraping off the toner on the surface of the pretreatment member is not provided, it is possible to simplify the configuration around the pretreatment member.

In this case, it is further preferable that a second opposing electrode is provided at a position facing the pretreatment member while sandwiching the intermediate transfer belt between the second opposing electrode and the pretreatment member. With such a preferred configuration, it is possible to increase the contact pressure between the pretreatment member and toner. Consequently, since the contact opportunity between the pretreatment member and toner is increased, the waste toner on the intermediate transfer belt can be removed completely by the cleaner roller. Furthermore, in this case, it is preferable that the second opposing electrode and the cleaner roller have the same potential. With such a preferred configuration, since an electric field is generated on the portion in which the pretreatment member is in contact with toner on the intermediate transfer belt, when the pretreatment member is in contact with toner, it is possible to remove a larger amount of positive charges on the toner at one touch and at the same time, and the toner can be charged normally. Furthermore, because the second opposing electrode and the cleaner roller have the same potential, it is not necessary to provide an additional power source or terminal. As a result, it is possible to realize the simple and inexpensive configuration. Furthermore, in this case, it is preferable that the cleaner roller is separable from the intermediate transfer belt. With such a preferred configuration, since the toner image is not disturbed due to the cleaner roller, it is possible to overlap toner images by rotating the intermediate transfer belt several times. Furthermore, in this case, it is preferable that a first conductive brush that is electrically grounded is provided at a position facing the cleaner roller while sandwiching the intermediate transfer belt between the first conductive brush and the cleaner roller. With such a preferred configuration, a cleaning electric field can be formed stably over the entire region of the cleaning nip, and the cleaning performance of the toner on the intermediate transfer belt is improved. As a result, even if the cleaning voltage is set to be low, it is possible to remove the waste toner completely and stably. Furthermore, it is possible to suppress the load variation when the cleaner roller is separated. Consequently, a high quality image can be obtained by suppressing the displacement of each toner image. Furthermore, in this case, it is preferable that the image forming apparatus includes a pretreatment roller that is electrically grounded and is pressed onto the intermediate transfer belt between the secondary transfer position and the cleaner roller, and a pretreatment roller disjunction mechanism for separating the pretreatment roller from the intermediate transfer belt. With such a preferred configuration, since a toner image is not disturbed due to the cleaner member, it is preferable to overlap toner images by rotating the intermediate transfer belt several times. Furthermore, in this case, it is possible that a second conductive brush having the same potential as that of the cleaner roller is provided at a position facing the pretreatment roller while sandwiching the intermediate transfer belt between the second conductive brush and the pretreatment roller. With such a preferred configuration, an electric field can be formed stably over the entire region of the nip of the pretreatment portion. Thus, the performance of charging toner on the intermediate transfer belt can be improved. Furthermore, since it is possible to suppress the load variation when the pretreatment roller is separated, a high quality image can be obtained while suppressing the displacement of each toner image.

Furthermore, a configuration of the cleaning device according to the present invention includes a cleaner member, which is rotated while being pressed onto a toner supporting member that moves with charged toner supported on the surface thereof and which maintains the potential for electrically attracting the toner from the toner supporting member, wherein the cleaner member is made of a metal having a high resistance layer on the surface thereof. According to the configuration of the cleaning device, electric charges are not accumulated on the surface of the cleaner member, and the toner is not provided with charges opposite to the charging polarity. Furthermore, since the cleaner member is made of a metal having a high electric resistance layer on the surface thereof, the surface of the cleaner member has an excellent abrasion resistance and the shape is not changed. Furthermore, as compared with the configuration in which the fur brush is used, the cleaner member is inexpensive and the configuration is simple. As a result, it is possible to perform a cleaning operation stably for a long time with a simple configuration.

Furthermore, it is preferable in the cleaning device according to the present invention that the cleaner member has an anodic oxidation coating on the surface thereof. With such a preferred configuration, a layer that is inexpensive and has high hardness and high electric resistance can be formed on the surface of the cleaner member easily. Consequently, the lifetime of the transfer belt unit can be increased and the configuration of the transfer belt unit can be inexpensive. Furthermore, in this case, it is preferable that the cleaner member is made of aluminum, having an alumite layer on the surface thereof.

Furthermore, it is preferable in the configuration of the cleaning device according to the present invention that the cleaner member and the toner supporting member move at different speeds from each other at a contact portion therebetween. With such a preferred configuration, the toner on the toner supporting member can be provided with both electric attraction force and mechanical shear force. Therefore, the waste toner on the toner supporting member can be removed completely.

Furthermore, it is preferable in the configuration of the cleaning device according to the present invention that the cleaner member and the toner supporting member move in the opposite direction at a contact portion therebetween. With such a preferred configuration, the toner on the toner supporting member can be provided with mechanical shear force without increasing the peripheral speed.

Furthermore, it is preferable in the configuration of the cleaning device according to the present invention that there is provided a scraper for scraping off the toner by being pressed onto the cleaner member. With such a preferred configuration, the toner on the cleaner member can be removed with an inexpensive and simple configuration. Furthermore, in this case, it is preferable that the scraper is a thin metal plate having a thickness of 30–80 $\mu$m. With such a preferred configuration, since the abrasion resistance of the scraper can be enhanced, it is possible to prevent the defective scraping of toner due to the faults or gaps at the tip of the scraper. Therefore, it is possible to remove toner on the cleaner roller for a long time stably and completely. Furthermore, in this case, it is preferable that a lubricant is attached to the surface of the cleaner member. With such a preferred configuration, the frictional coefficient between the cleaner member and the scraper is reduced, and the abrasion of the scraper can be reduced. Furthermore, since the force of the cleaner member to carry the toner is reduced, the toner on the cleaner member can be scraped off easily. As a result, it is possible to scrape off the toner with the scraper for a long time. Furthermore, in this case, it is preferable that the surface roughness $R_{max}$ of the cleaner member is 0.5–8

μm. With such a preferred configuration, it is possible to scrape off the toner on the cleaner member with the scraper.

Furthermore, a configuration of the cleaner unit according to the present invention includes, as an integrated unit, a cleaner member made of metal, a high resistance layer on the surface thereof, which is rotated while being pressed onto a toner supporting member that moves with charged toner supported on the surface thereof; a potential supplying means for supplying potential for electrically attracting the toner to the cleaner member, a scraper for scraping off the toner by being pressed onto the cleaner member, a waste toner case for collecting the toner scraped off from the cleaner member; and a seal member for preventing the toner from leaking from the gap between the cleaner member, and the scraper and the waste toner case; wherein the integrated unit is attached to the toner supporting member detachably. According to the configuration of this cleaner unit, the inside of the waste toner case is sealed with a sealing member and cleaner member, and the waste toner is not scattered to the outside of the apparatus when the cleaner unit is replaced with a new one. Furthermore, since the waste toner can be disposed of to the outside of the apparatus by the replacement of the attachable and detachable cleaner unit, it is possible to keep the apparatus main body in good condition for a long time by simple maintenance. Furthermore, since the cleaner member, the scraper, and the seal member are integrated into one unit, the positional accuracy of the whole apparatus can be maintained simply to the predetermined value. Furthermore, electric charges are not accumulated on the surface of the cleaner member, and toner is not provided with charges opposite to the charging polarity. Furthermore, the surface of the cleaner member has an excellent abrasion resistance and the shape is not changed. Furthermore, as compared with the configuration in which the fur brush is used, the cleaner member is inexpensive and the configuration is simple. As a result, it is possible to perform cleaning operation stably for a long time with an inexpensive configuration.

Furthermore, it is preferable in the cleaner unit according to the present invention that the cleaner member is made of aluminum, having an alumite layer on the surface thereof. With such a preferred configuration, a layer that is inexpensive and has high hardness and high electric resistance can be formed on the surface of the cleaner member easily.

Furthermore, it is preferable in the cleaner unit according to the present invention that the surface roughness $R_{max}$ of the cleaner member is 0.5–8 μm. With such a preferred configuration, the toner on the cleaner member can be scraped off with the scraper.

DETAILED DESCRIPTION OF THE INVENTION

The following is a detailed explanation of the present invention with reference to the embodiments.

FIRST EMBODIMENT

The following is an explanation of a first embodiment of an image forming apparatus according to the present invention, with reference to FIGS. 1 to 5.

Figure 1:
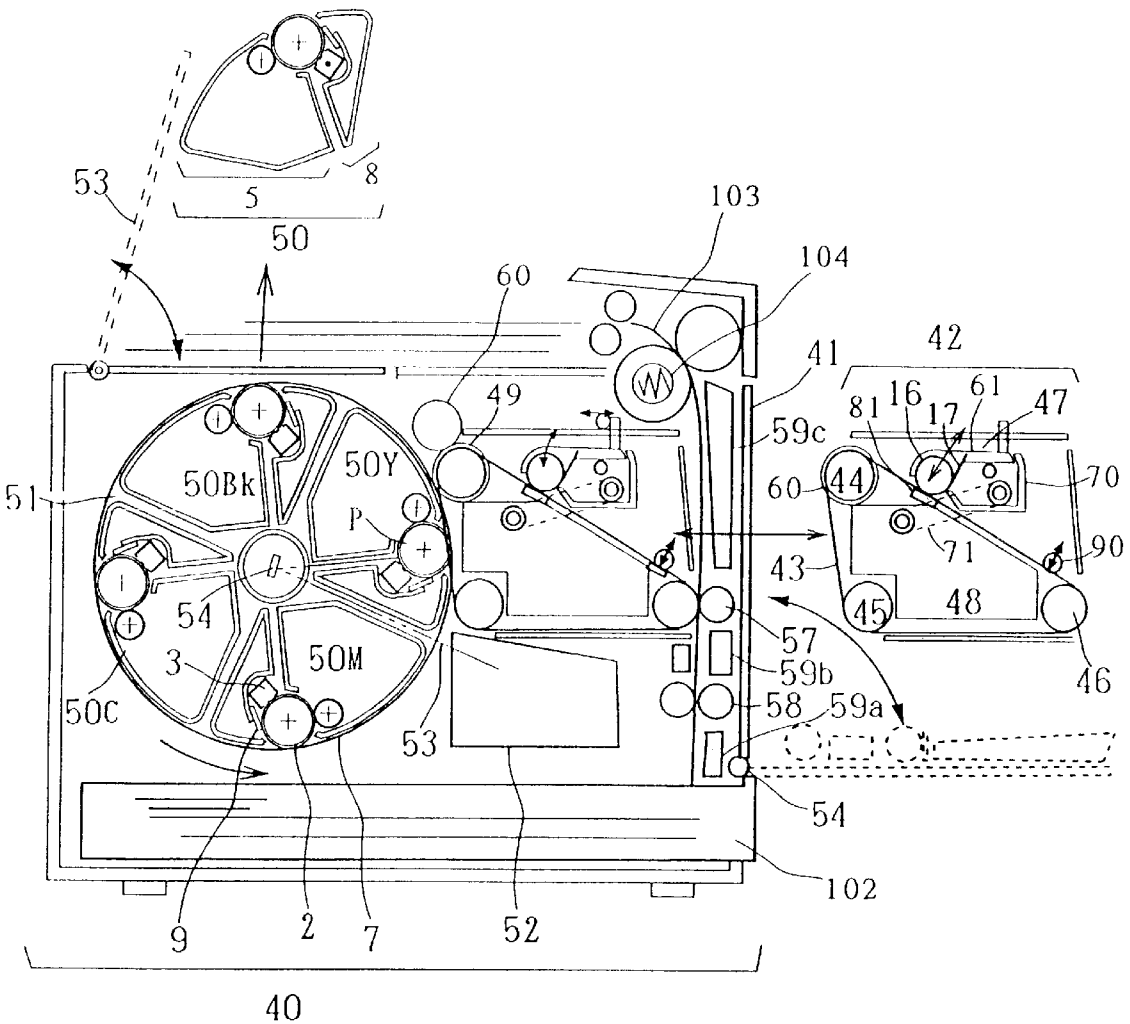
FIG. 1 is a cross-sectional view showing a configuration of an image forming apparatus in a first embodiment according to the present invention.

FIG. 1 is a cross-sectional view showing a configuration of an image forming apparatus of a first embodiment according to the present invention. In FIG. 1, the right-hand face is the front face of the color image forming apparatus 40. The front face is provided with a front door 41. Reference numeral 42 is a transfer belt unit for copying (primary transfer) a toner image formed on the photosensitive member 2 at an image forming position (a primary transfer position) P and transferring again (secondary transfer) the copied toner image onto a recording paper. The transfer belt unit 42 includes an intermediate transfer belt 43, three supporting axes including a driving axis 44 for suspending the intermediate transfer belt 43, a tension axis 45 and an opposing axis 46 for the secondary transfer, a cleaner 47 and a waste toner case 48 for collecting the waste toner. These members are integrated into one unit and attached to the color image forming apparatus 40 detachably. In this case, as shown in FIG. 1, by opening the front door 41 provided on the front face of the color image forming apparatus 40, the transfer belt unit 42 can be attached or detached. Since the cleaner 47, the waste toner case 48 and the intermediate transfer belt 43 are integrated into one unit, when the transfer belt unit 42 is replaced with new one, it is possible to remove the waste toner to the outside of the apparatus without spilling toners at the same time of the replacement of the intermediate transfer belt 43. Therefore, maintenance can be performed easily without contaminating the inside of the main body of the color image forming apparatus 40 with the waste toner. Furthermore, with such an integrated configuration, it is possible to maintain the accuracy of the positional relationship between the intermediate transfer belt 43 or the opposing brush 81 and the cleaner roller 16 at the predetermined value easily. Therefore, it is possible to keep the color image forming apparatus 40 main body in good condition for a long time with only simple maintenance.

The intermediate transfer belt 43 is an endless belt having a thickness of about 100 μm, a width of about 250 mm and is made of a film made of semiconductive polycarbonate having, for example, a surface resistivity of $1\times10^9$ Ω/□ and a volume resistivity of $1\times10^9$ Ω·cm. The driving axis 44 for suspending the intermediate transfer belt 43, the tension axis 45 and the opposing axis 46 are respectively made of aluminum pipes having a diameter of 30 mm. The intermediate transfer belt 43 is provided with tension force of 2–3 kgf by the tension axis 45.

A carriage 51 is provided in the vicinity of the transfer belt unit 42 on the left side of the inside of the color image forming apparatus 40. Four image forming units 50Y, 50M, 50C and 50Bk for yellow (Y), magenta (M), cyan (C), and black (Bk), each unit having a sector shape, are arranged and retained circularly in the carriage 51. The carriage 51 can be rotated in the arrow direction.

An image forming unit 50, integrating the process elements arranged around each of the various photosensitive members 2, includes the following components. The photosensitive member 2 is made of a drum pipe having a diameter of 30 mm and can be rotated at a peripheral speed of about 100 mm/sec.

Reference numeral 3 denotes a corona charger for negatively charging the photosensitive member 2 homogeneously, reference numeral 5 denotes developers each having yellow, magenta, cyan and black toners and attaching the negatively charged toner to a static latent image on the photosensitive member 2 facing a developing roller 7, thereby forming a toner image of each color. The toner of each color is made of polyester resin, and a pigment dispersed in the resin, and has an average particle diameter of 8 μm. Reference numeral 8 denotes a cleaner for cleaning off toner remained on the surface of the photosensitive member 2 after the transfer. This cleaner 8 includes a cleaning blade 9 made of rubber. In FIG. 1, reference numeral 52 denotes a laser exposure device provided at the lower part of the transfer belt unit 42.

The image forming units 50Y–50Bk can be attached/detached into/from the inside of the color image forming apparatus 40 by opening an upper-surface cover 53 on the upper surface of the color image forming apparatus 40. The image forming unit 50 is integrated into the main body of the color image forming apparatus 40 via an interactive coupling member (not shown) of the mechanical driving system and electric circuit system at the side of the color image forming apparatus 40 main body. When the carriage 51 is rotated, the image forming units 50Y–50Bk are rotated around a mirror 54 that does not rotate. When an image is formed, the image forming units 50Y–50Bk are respectively positioned in the image forming position P (primary transfer position) facing the intermediate transfer belt 43. This image forming position P is also an exposure position with respect to a laser beam 53.

The front door 41 is hinged to the color image forming apparatus 40 main body with a hinge 54, and can be lowered and opened towards the front. The front door 41 is provided with a secondary transfer roller 57, a resist roller 58 and paper guides 59*a*, 59*b* and 59*c*. When the front door 41 is lowered toward the front, these components also are lowered toward the front together. Therefore, it is possible to open the front surface of the color image forming apparatus widely and to attach/detach the transfer belt unit 42 into/from this opened part. At the same time, it is possible to remove paper easily at the time of paper jamming.

The transfer belt unit 42 is positioned reliably at the predetermined position when it is attached to the main body of the color image forming apparatus 40. At this time, as shown in FIG. 3, the driving axis gear 49 at the tip of the driving axis 44 engages the main gear 60 of the main body of the color image forming apparatus 40, and the transfer belt unit 42 is also electrically connected to the main body of the color image forming apparatus 40, whereby the intermediate transfer belt 43 can be operated.

Figure 2:
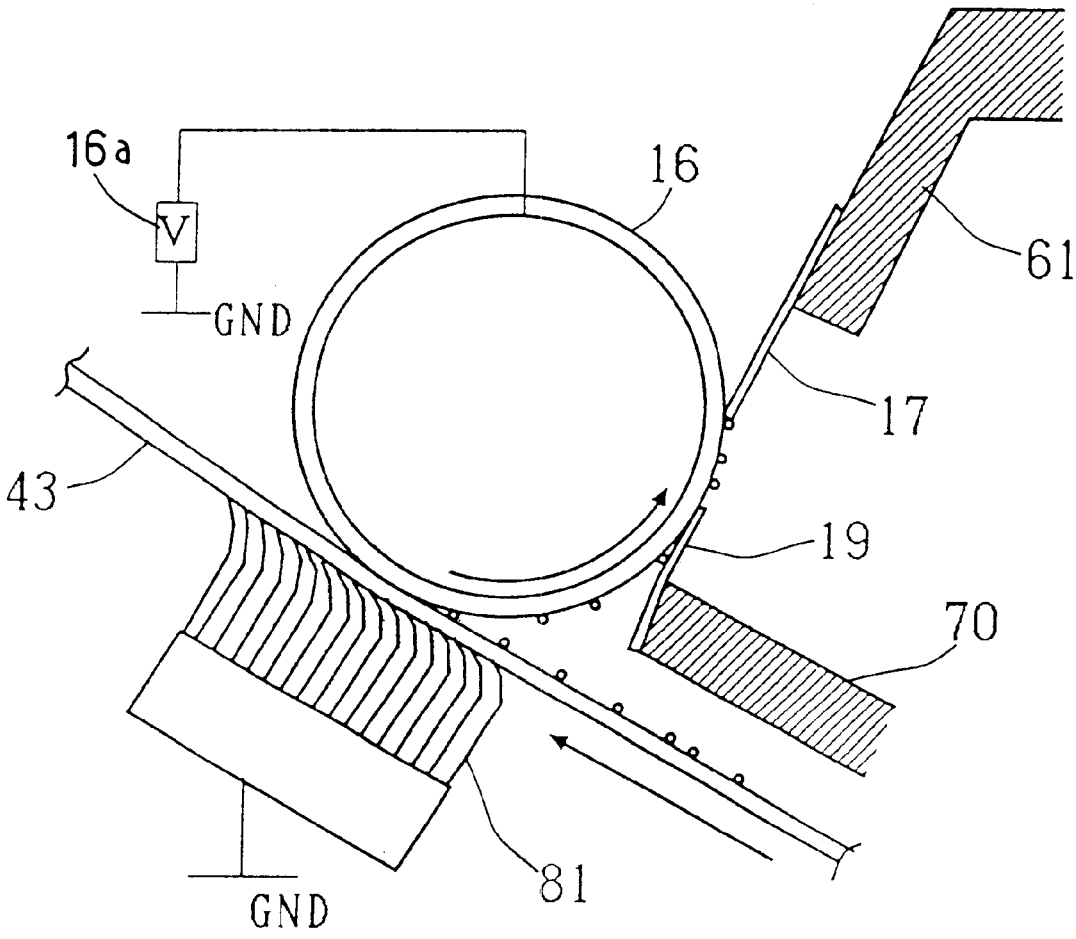
FIG. 2 is an enlarged view showing a cleaning portion of a transfer belt unit in the first embodiment according to the present invention.
Figure 3:
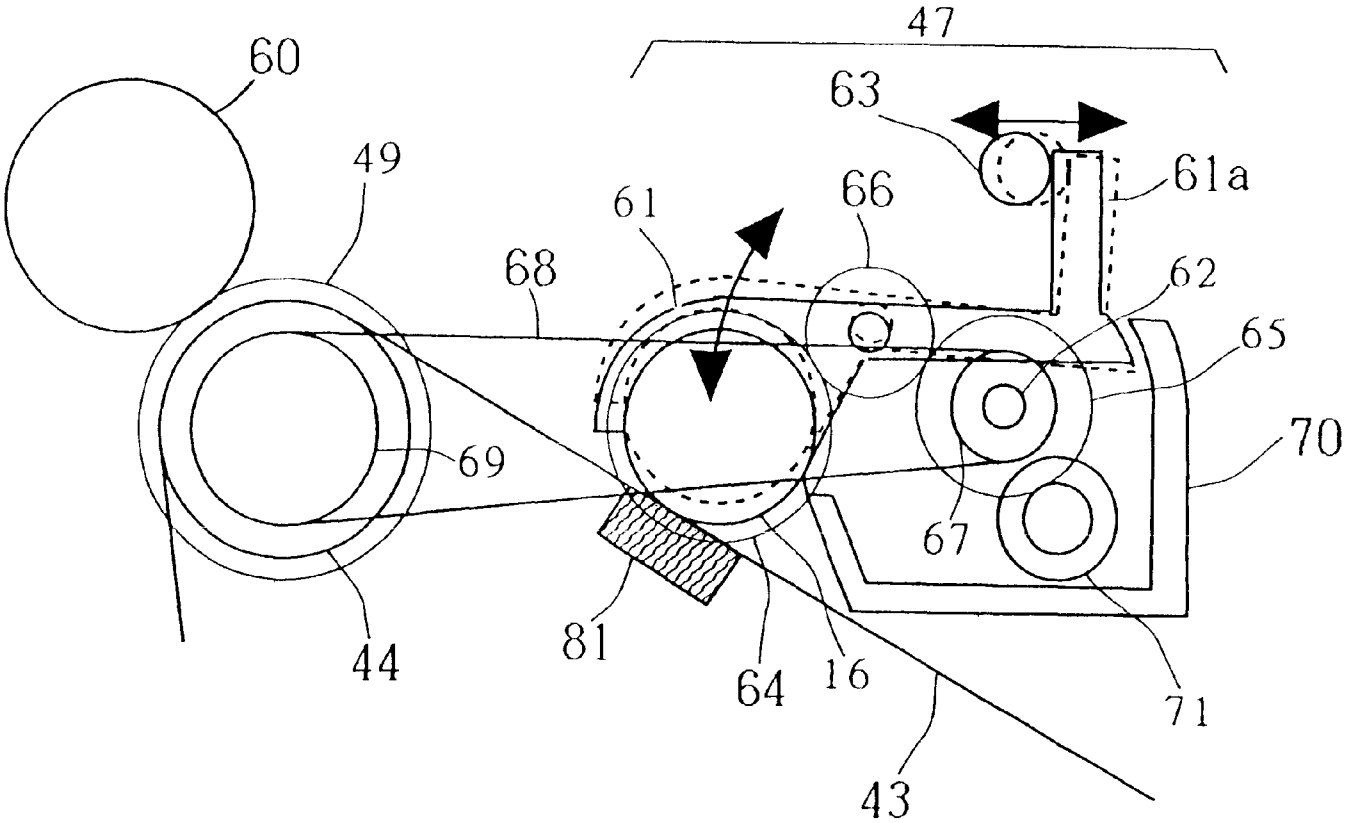
FIG. 3 is a view showing a configuration of a cleaner in the first embodiment according to the present invention.

FIG. 2 is an enlarged view showing a cleaning portion of the transfer belt unit 42, and FIG. 3 is a view showing a configuration of a cleaner 47. As shown in FIGS. 1 to 3, the cleaner 47 cleans off toner remaining on the intermediate transfer belt unit 43. The cleaner 47 includes a cleaner roller 16, a scraper 17, a cleaner case 61, a waste toner receiver 70, a pick-up seal 19 and a side seal (not shown) for preventing toner from leaking from the gap between the end portion of the cleaner roller 16 and the waste toner receiver 70. The cleaner 47 is formed by integrating these members into one unit and is attached to the main body of the color image forming apparatus 40 detachably.

The cleaner roller 16 is made of an aluminum pipe of an outer diameter of 25 mm having 8 μm thick alumite layer on the surface thereof. The surface roughness $R_{max}$ is 3 μm or less. The alumite layer of the surface is impregnated with Teflon (polytetrafluoroethylene, PTFE) . The scraper 17 is made of a stainless thin plate having a thickness of 50 μm and is capable of scraping off the toner on the cleaner roller 16 by being pressed onto the surface of the cleaner roller 16. Herein, the cleaner roller 16 and the scraper 17 are held by the cleaner case 61.

The cleaner case 61 can be rotated with the rotation axis 62 as the center and is urged towards the direction in which the cleaner roller 16 is pressed onto the intermediate transfer belt 43 by a spring (not shown). At this time, the cleaner roller 16 is pressed onto the intermediate transfer belt 43 so that the cleaner roller 16 extends beyond the common tangent of the driving axis 44 and the opposing axis 46 by only 1 mm. The cleaner roller 16 is connected to a DC power source 16*a*, and +300V DC voltage (cleaner voltage) is applied to the cleaner roller 16 from the DC power source 16*a*. An arm portion 61*a* of the cleaner case 61 is in contact with a disjunction lever 63 at the side of the color image forming apparatus 40 main body and cleaner roller 16 is separated from the intermediate transfer belt 43 in accordance with the movement of the disjunction lever 63. The cleaner roller 16 and the intermediate transfer belt 43 rotate in the opposite directions at the same speed at the contact portion. The cleaner gear 64 attached to the cleaner roller 16 is driven coaxially by the rotation axis gear 65 attached to the rotation axis 62 of the cleaner case 61 via an idler gear 66, whereby the cleaner gear 64 also is successively driven during the operation of the cleaner case 61. The rotatable gear 65 is provided with a driven force from the driving axis pulley 69 integrated with driving axis gear 49 of the driving axis 44 via a timing belt 68 and a rotatable axis pulley 67.

The waste toner receiver 70 receives and collects the toner scraped off by the scraper 17. The pick-up seal 19 is in contact with the cleaner roller 16 facing the scraper 17. Thus, it is possible to prevent the toner on the cleaner roller 16 from dropping off therefrom and to prevent the toner accumulated in the waste toner receiver 70 from spilling out to the outside from the inside.

At the end of the waste toner receiver 70, a conveying pipe 71 is provided. This conveying pipe 71 is connected to the inside of the waste toner case 48 provided inside the intermediate transfer belt 43. Inside the place between the waste toner receiver 70 to the conveying pipe 71, a conveying coil (not shown) is arranged. With the rotation of this conveying coil, toner accumulated in the waste toner receiver 70 is carried to the waste toner case 48.

Reference numeral 81 denotes an opposing brush, as an opposing electrode, which is provided facing the cleaner roller 16 while sandwiching the intermediate transfer belt 43 between the cleaner 16 and the opposing brush 81. The opposing brush 81 is formed by planting brush fibers (fiber having carbon dispersed in rayon) having a thickness of 600 denier and made of semiconductive rayon. The brush fibers are planted on a conductive base material at $10^5$ fibers/inch$^2$. The height of the planted brush fiber is 5 mm and the planting width is 5 mm. When the opposing brush 81 is brought into contact with the metal plate with the length of 220 mm and the pushing depth of 1 mm, the electric resistance is $10^3$ to $10^5\Omega$.

The opposing brush 81 is electrically grounded. At the time of cleaning, the cleaner roller 16 presses onto the opposing brush 81 via the intermediate transfer belt 43. When the cleaner roller 16 is separated from the intermediate transfer belt 43, the opposing brush 81 is in slightly contact with the intermediate transfer belt 43 and hardly affect the movement of the intermediate transfer belt 43.

As mentioned above, by using the flexible opposing brush 81 as an opposing electrode for the cleaner roller 16, a cleaning electric field can be formed stably over the entire region of the cleaning nip. Since the cleaning field can be formed stably, it is possible to improve the performance of cleaning off toner on the intermediate transfer belt 43. As a result, even if the cleaning voltage is set to be low, it is possible to remove the waste toner completely and stably. Furthermore, by using the flexible opposing blush 81, it is possible to press the intermediate transfer belt 43 onto the cleaner roller 16 over the entire cleaning nip with the opposing brush 81. Therefore, even if there is a distortion or deformation in the intermediate transfer belt 43, it is possible to secure the stable cleaning nip. Consequently, it is possible to secure both the friction force and electric field force that are applied to the toner on the intermediate transfer belt 43. Thus, the sufficient cleaning performance can be exhibited, and the waste toner can be removed stably and completely.

Furthermore, since the opposing brush 81 is fixed and is not rotated, it can be fabricated with a simple configuration at low cost. In addition, since it is possible to reduce the thickness of the opposing brush 81 than the length in the width direction thereof, the volume occupied in the apparatus can be reduced. Accordingly, the volume of the waste toner case 48 provided inside the intermediate transfer belt 43 can be increased, thus increasing the lifetime until the waste toner case 48 is full. As a result, the lifetime of the transfer belt unit 42 can be increased and maintenance can be reduced.

Figure 4:
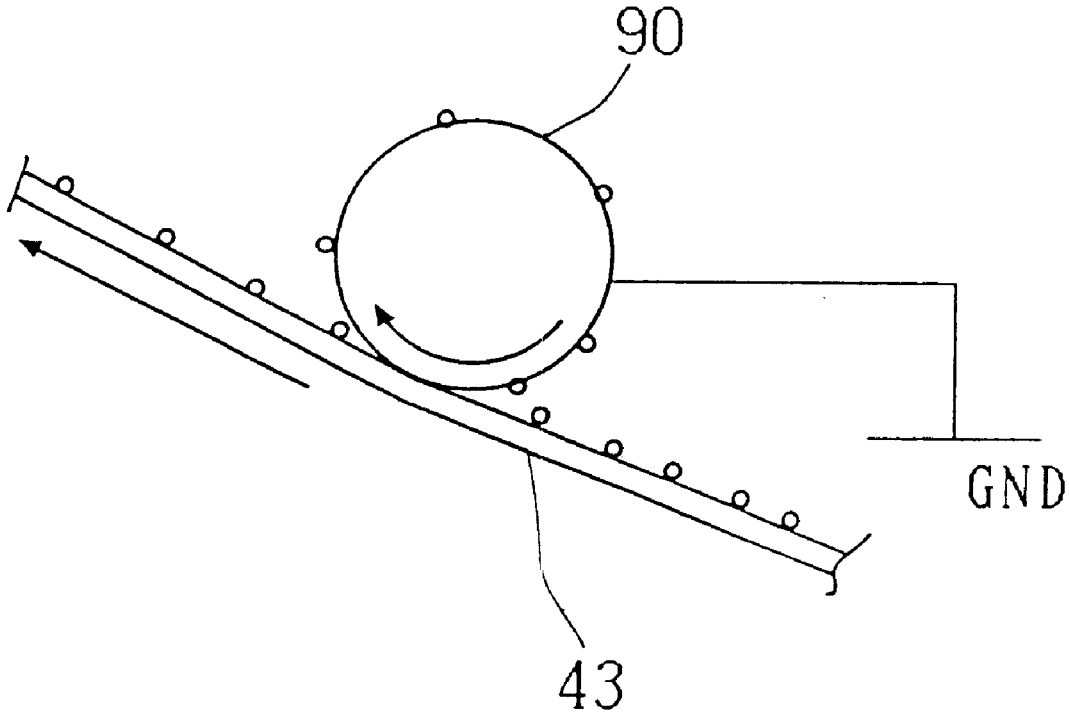
FIG. 4 is an enlarged view showing a portion in which a pretreatment roller is pressed onto an intermediate transfer belt in the first embodiment according the present invention.
Figure 5:
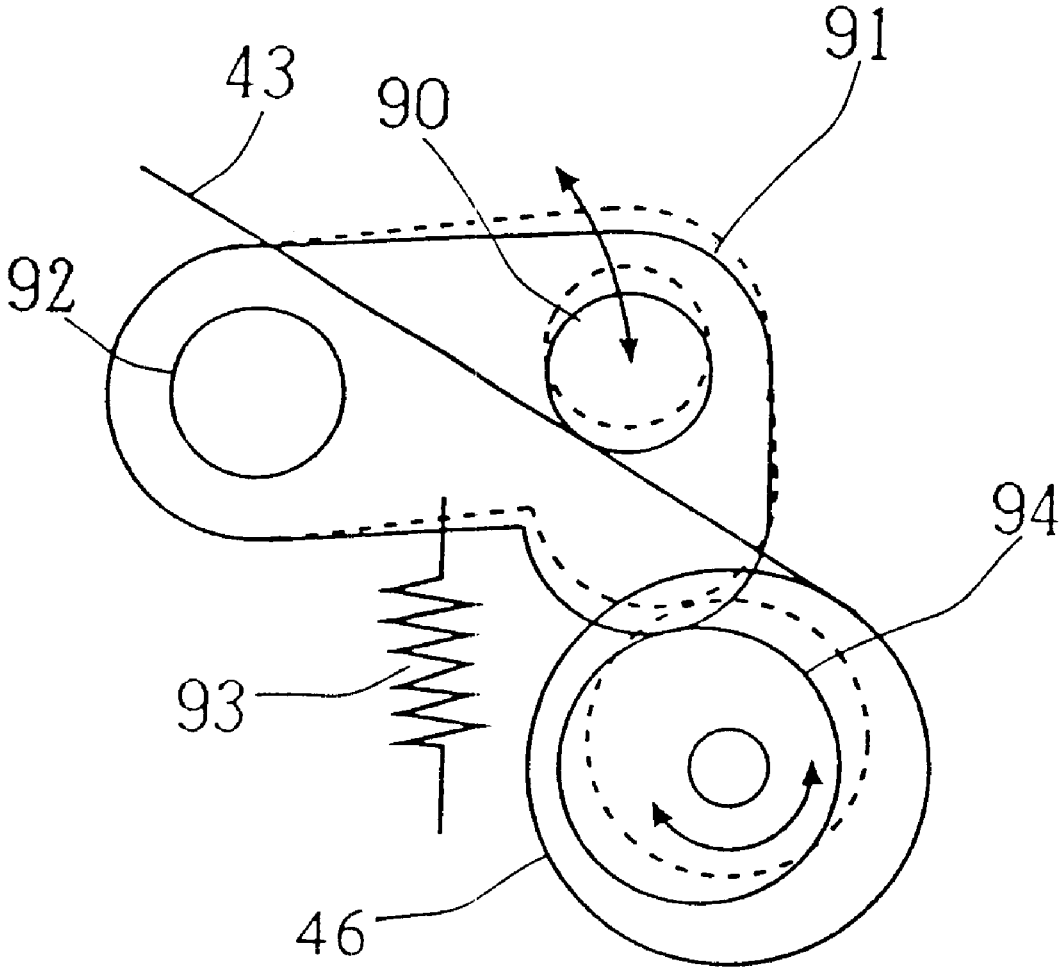
FIG. 5 is a view showing a configuration of a holder of the pretreatment roller in the first embodiment of the present invention.

FIG. 4 is an enlarged view showing a portion in which a pretreatment roller 90 is pressed onto the intermediate transfer belt 43. FIG. 5 is a view showing a configuration of a holder of the pretreatment roller 90. As shown in FIGS. 1, 4 and 5, the pretreatment roller 90 is made of a conductive metal, for example, stainless steel, having a diameter of 10 mm, which is held by the intermediate transfer belt 43 separably. The pretreatment roller 90 is in contact with only the intermediate transfer belt 43 between the cleaner roller 16 and the opposing axis 46 (upstream from the cleaner roller 16 in the rotation direction on the intermediate transfer belt 43). The pretreatment roller 90 is not provided with a member for scraping off toner on the surface of the pretreatment roller 90. Reference numeral 91 denotes an arm holding the pretreatment roller 90 capable of being driven by a friction force generated between the intermediate transfer belt 43 and the pretreatment roller 90. The arm 91 also works as a bearing of the pretreatment roller 90. The arm 91 can be rotated with the rotation axis 92 as its center and is urged toward the direction in which the cleaner roller 90 is pressed onto the intermediate transfer belt 43 by an arm spring 93 by the force of 300 gf. The arm 91 moves upward and downward in accordance with the rotation of a disjunction cam 94 with which the arm 91 is in contact, whereby the pretreatment roller 90 is separated from the intermediate transfer belt 43. The disjunction cam 94 is provided at both ends of the pretreatment roller 90 so that the pretreatment roller 90 moves in parallel with respect to the intermediate transfer belt 43. The pretreatment roller 90 is electrically grounded similar to the opposing brush 81.

It is desirable that the surface roughness Ra of the pretreatment roller 90 is 5–20 $\mu$m. This surface roughness can be obtained by, for example, performing a sand-blasting procedure on the surface of the pretreatment roller 90. When the surface roughness Ra of the pretreatment roller 90 is set to be 5–20 $\mu$m, since the mechanical shear force applied to the toner on the intermediate transfer belt 43 is increased, aggregated toner can be pulverized. Therefore, it is possible to prevent the intermediate transfer belt 43 from being deformed due to the aggregated toner and also prevent the toner around the aggregated toner from failing to be in contact with the pretreatment roller 90. Therefore, it is possible to bring the toner around the aggregated toner into contact with the pretreatment roller 90 and the cleaner roller 16, thus removing the toner completely.

Next, the following is an explanation of the operation of an image forming apparatus having the above-mentioned configuration.

First, the carriage 51 is rotated and the yellow image forming unit 50Y is carried to the image forming position P (state illustrated in FIG. 1). In this state, the laser beam 53 passes through the light path formed between the yellow image forming unit 50Y and the magenta image forming unit 50M, and is reflected by the mirror 54 and enters the photosensitive member 2 at the image forming position P to form a static latent image on the photosensitive member 2. This static latent image is developed by toner that is carried by a developing roller 7 of a developer 5 to form a toner image on the photosensitive member 2. Next, the yellow toner image formed on the photosensitive member 2 is primarily transferred to the intermediate transfer belt 43. When the yellow toner image is formed, the carriage 51 is rotated 90° in the arrow direction so as to transfer the magenta image forming unit 50M into the image forming position P. Thereafter, the same operation is performed as the case of the yellow. The magenta toner image is overlapped onto the yellow toner image on the surface of the intermediate transfer belt 43. Moreover, the same operations are performed sequentially for a cyan toner image and a black toner image so as to form a toner image in which toner images of four colors are overlapped on the intermediate transfer belt 43. When four colors are overlapped, the cleaner roller 16, the pretreatment roller 90 and the secondary transfer roller 57 are separated from the intermediate transfer belt 43. Therefore, the toner image on the intermediate transfer belt 43 is not disturbed.

When images of four colors are formed, a charger 3 charges the photosensitive member 2 at −450V. The potential of the photosensitive member 2 after exposure is −50V. A DC voltage of −250V is applied to the developing roller 7. Furthermore, a DC voltage of +700V is applied to the driving axis 44 and the tension axis 45 as the primary transfer voltage. The opposing axis 46 is electrically grounded.

Until the tip of the fourth toner image, i.e. a toner image, on the intermediate transfer belt 43 reaches the secondary transfer position, a secondary transfer roller 57 is brought into contact with the intermediate belt 43. Then, the recording paper 103 fed out of a feeding unit 102 is conveyed to the nip portion between the secondary transfer roller 57 and the intermediate transfer belt 43 in timing so as to transfer the four-color toner images onto the recording paper 103 (secondary transfer). The recording paper 103 on which the toner image is transferred is fixed on the recording paper 103 by passing through a fixing device 104, and is ejected out of the apparatus.

At the secondary transfer, a voltage (+800V) of positive polarity is applied to the secondary transfer roller 57. Consequently, a part of the toner remaining on the intermediate transfer belt 43 after passing through the secondary transfer portion is charged to have the opposite polarity, i.e., the positive polarity. Since the toner with the opposite polarity is electrically repulsive with respect to the cleaner roller 16 on which the positive voltage is applied, the toner with the opposite polarity cannot be removed from the intermediate transfer belt 43.

Therefore, in this embodiment, until the toner remaining on the intermediate transfer belt 43 after the secondary transfer reaches the pressing portion of the pretreatment roller 90, the pretreatment roller 90 is allowed to be pressed onto the intermediate belt 4. Thereby, the toner remaining on the surface of the intermediate transfer belt 202 is brought into contact with the pretreatment roller 90 to be frictionally charged. As a result, the toner that is carried to the cleaning portion returns to the normal polarity. Therefore, the toner remaining on the intermediate transfer belt 43 after the secondary transfer can be removed by the cleaner roller 16 to which the positive voltage is applied.

Next, until the toner remained on the intermediate transfer belt 43 reaches the cleaning portion, the cleaner roller 16 is pressed onto the intermediate transfer belt 43. Thereby, the toner remaining on the intermediate transfer belt 43 is removed by the mechanical friction force and electrical attraction force of the cleaner roller 16. Since the toner is allowed to be adsorbed by the electrical attraction force, even if the cleaner roller 16 is apart from the intermediate transfer belt 43, the toner does not drop off onto the intermediate transfer belt 43. Therefore, it is possible to set freely the direction of the plane of the intermediate transfer belt 43 in the cleaning portion. Since the length of the circumference of the intermediate transfer belt 43 from the primary transfer position to the cleaning position is shorter than the length of the image, when the cleaner roller 16 starts to be pressed, during the primary transfer of the black image, the cleaner roller 16 is pressed onto the intermediate transfer belt 43.

In this embodiment, by providing the pretreatment roller 90 returning the toner that is carried to the cleaning portion to the normal polarity, the waste toner can be removed with lower cleaning voltage. Furthermore, by setting the cleaning voltage to be low, it is possible to suppress the variation of the load by the cleaner roller 16, thus to suppress the displacement at the time of disjunction of the cleaner roller 16.

Furthermore, by the primary transfer voltage (+700V) and the secondary transfer voltage (+800V), the potential of the surface of the intermediate transfer belt 43 becomes positive. Therefore, toner with a positive polarity is attached to the pretreatment roller 90 that is electrically grounded. Since the pretreatment roller 90 and the intermediate transfer belt 43 are rotated in the same direction on the contact portion therebetween and there is not provided a member for scraping off the toner to the surface of the pretreatment roller 90, the toner attached on the pretreatment roller 90 passes again through the nip portion with the intermediate transfer belt 43. As a result, the opportunity where the pretreatment roller 90 and the toner are in contact with each other is increased the positive charge of the larger amount of toner remained after transfer can be removed by the pretreatment roller 90. Therefore, it is possible to remove the waste toner on the intermediate transfer belt completely. Furthermore, since there is not provided a member for scraping off the toner on the surface of the pretreatment roller 90, it is possible to simplify the configuration of the pretreatment roller 90.

Furthermore, since the length of the non-image portion between the rear end and tip end of the image on the intermediate transfer belt 43 is shorter than the gap between the cleaner roller 16 and the primary transfer position, it is possible to shorten the peripheral length of the intermediate transfer belt 43 and thus to downsize the transfer belt unit 42 and the color image forming apparatus 40. Furthermore, since the time necessary for the intermediate transfer belt 43 to rotate once is shortened, thus the time necessary for the intermediate transfer belt 43 to rotate four times is shortened. Consequently, the throughput of the color image formation on the intermediate transfer belt 43 is improved. Furthermore, by pressing the cleaner roller 16 onto the intermediate transfer belt 43 before the transfer of the toner image onto the intermediate transfer belt 43 is finished, it is possible to improve the throughput of the formation of the color image formation on the intermediate transfer belt 43.

After one image formation is finished, the rotation of the intermediate transfer belt 43 etc. is stopped once and the yellow image forming unit 50Y is carried into the image forming position P to prepare the following image formation.

When outputting images successively, before the tip of the first color (yellow) toner image reaches the cleaning portion, the cleaner roller 16 is separated from the intermediate transfer belt 43. In this case, after the primary transfer of the yellow toner image starts, the cleaner roller 16 is separated from the intermediate transfer belt 43. In this way, since the cleaner roller 16 is separated from the intermediate transfer belt 43 when the toner image passes through the cleaning position, the toner image on the intermediate transfer belt 43 is not disturbed due to the cleaner roller 16.

The toner attached to the cleaner roller 16 is scraped off by the scraper 17 and collected in the waste toner receiver 70. The toner collected in the waste toner receiver 70 is carried to the waste toner case 48 through the conveying pipe 71. When the waste toner case is full after a long time of use, the cleaner 47, the intermediate transfer belt 43, the waste toner case 48, and the like, are replaced with a new one as an integrated transfer belt unit 42.

As mentioned above, since the primary transfer voltage of +700V is applied to the driving axis 44 and the tension axis 45 and the opposing axis 46 in the vicinity thereof is electrically grounded and is maintained at different potential. Therefore, if the opposing electrode member does not exist, due to the change of the resistance value of the intermediate transfer belt 43, the potential in the cleaning portion changed. The change of the resistance value of this intermediate transfer belt 43 is caused by the environment or attached substances on the surface of the intermediate transfer belt 43. Furthermore, the secondary transfer roller 57 is separated and the secondary transfer voltage is also changed by the environment. Therefore, the potential of the intermediate transfer belt 43 in the cleaning position is likely to be unstable. However, in this embodiment, since the opposing brush 81 that is electrically grounded is provided so as to be pressed onto the intermediate transfer belt 43, the potential of the intermediate transfer belt 43 in the cleaning position becomes stable, and thus stable cleaning performance can be attained.

In order to clean off the negative toner attached to the secondary transfer roller 57 after coping with paper jamming, the voltage having a polarity opposite to that at the secondary transfer (negative polarity) is applied to the secondary transfer roller 57. At this time, the intermediate transfer belt 43 has a negative voltage. Therefore, a large amount of toner having negative polarity on the intermediate transfer belt 43 is attached to the pretreatment roller 90 having a grounded potential, thus the pretreatment roller 90 cannot be in contact with the toner on the intermediate transfer belt 43.

Therefore, in this embodiment, after the voltage having the same polarity as the charged polarity (negative polarity) of toner is applied to the secondary transfer roller 57, the voltage having a polarity opposite to the charging polarity (positive polarity) of toner is applied to the secondary transfer roller 57 while allowing the pretreatment roller 90 to be rotated at least once. Thereby, the toner attached to the pretreatment roller 90 is attached to the intermediate transfer belt 43. Consequently, the pretreatment roller 90 can be in contact with the intermediate transfer belt 43, again.

As mentioned above, when the cleaner roller 16 is separated from the intermediate transfer belt 43, the rotation load of the intermediate transfer belt 43 and the driving axis 44 are varied. Therefore, elastic deformation of the component elements which allow rotation of the driving axis 44 or sliding between the driving axis 44 and the intermediate transfer belt 43 to occur. Thereby, the speed of the intermediate transfer belt 43 is changed, causing the gap of timing for overlapping toner images of a plurality of colors. As a result, the image formed after the cleaner roller 16 is separated is displaced from the images of the previous colors.

The present inventors have determined that the load generated by separating the cleaner roller 16 from the intermediate transfer belt 43 is dependent upon the applied voltage (cleaner voltage). The following is the explanation of this finding.

Figure 6:
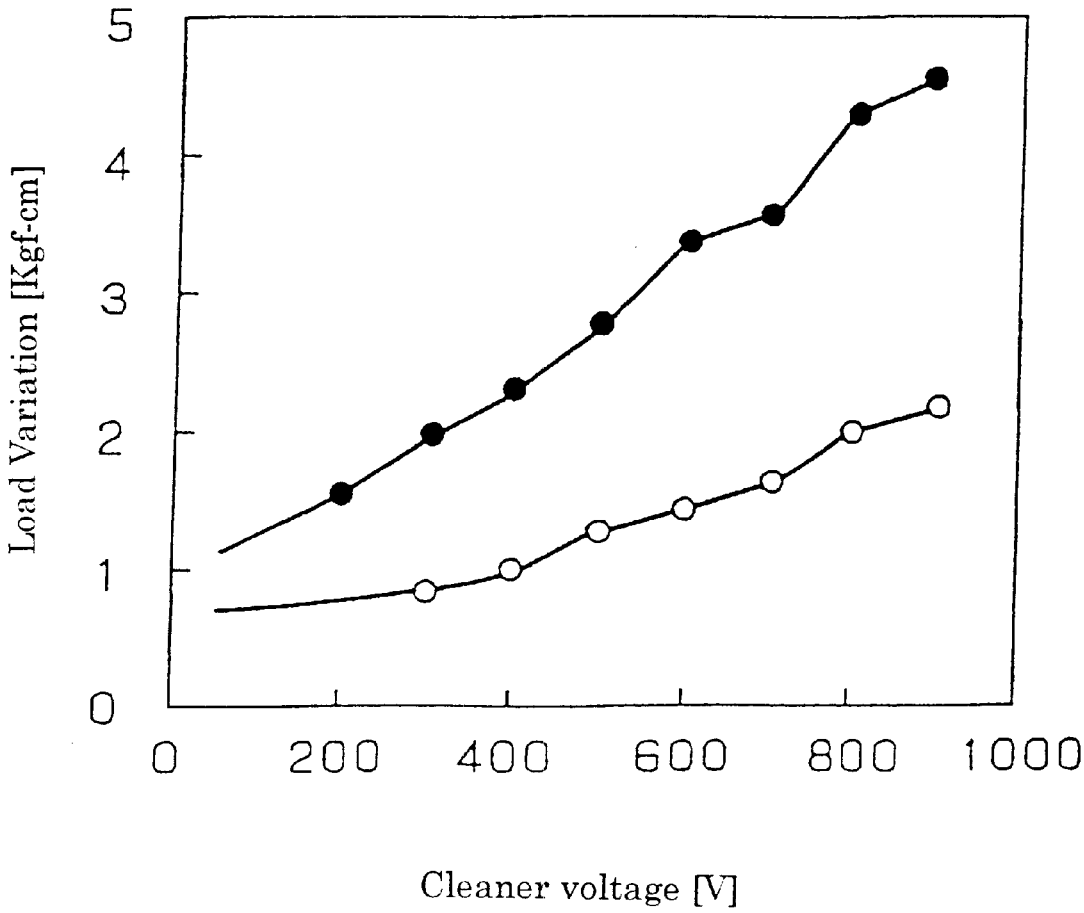
FIG. 6 is a graph showing a relationship between a cleaner voltage and variation of the load applied to a driving axis in the first embodiment according to the present invention.

FIG. 6 is a graph showing a relationship between the cleaner voltage and a variation of load applied to a driving axis 44. In FIG. 6, the horizontal axis shows the cleaner voltage and the vertical axis shows the variation of the load when the cleaner roller 16 is separated from the intermediate transfer belt 43. In the graph, a white circle (○) represents the results when the opposing brush 81 is used as the opposing electrode, and a black circle (●) represents the results when an opposing electrode sheet is used as the opposing electrode (see the below mentioned fourth embodiment, and reference numeral 30 of FIG. 11). The results of FIG. 6 show that it is possible to suppress the load variation more effectively in the case where the opposing electrode sheet is used as compared with the case where the opposing electrode brush is used for the opposing electrode. The difference can be explained as follows. That is, the opposing electrode is attracted towards the intermediate transfer belt 43 by electrical attraction. When the opposing brush 81 was used as the opposing electrode, fine fibrous tip portions of the brush are electrically attracted to the intermediate transfer belt 43. At first, the brush tip portion moves to follow the rotating intermediate transfer belt 43. However, the movement of the brush tip portion is limited and deformed in the direction in which the brush tip portion is away from the intermediate transfer belt 43 because the opposing brush 81 is fixed at the base portion. In this way, the tip portion of the brush is separated from the intermediate transfer belt 43, and the friction between the intermediate transfer belt 43 and the brush does not occur. Thus, it is possible to suppress the load variation due to the cleaner voltage.

Therefore, by using the flexible opposing brush as the opposing electrode, it is possible to suppress the load variation due to the cleaner roller 16. As a result, it is possible to prevent sliding between the driving axis 44 and the intermediate transfer belt 43, or displacement due to the warp of the driving system of the driving axis 44.

In this embodiment, the pretreatment roller 90 is electrically grounded. However, if the pretreatment roller 90 is designed to have a surface with a charging property that is opposite to the charging property of toner, when the pretreatment roller 90 is in contact with toner, it is possible to remove a larger amount of positive charges on the surface of the toner by only one touch by the use of the pretreatment roller 90. Since the pretreatment roller 90 can remove a larger amount of positive charge on the toner, the waste toner on the intermediate transfer belt 43 can be removed completely.

Furthermore, in this embodiment, the tip portion of the opposing brush 81 is in contact with the path of the intermediate transfer belt 43. However, it is not limited to the configuration shown in the above embodiments. For example, the tip portion of the opposing brush 81 may be separated from the intermediate transfer belt 43 by a length shorter than the portion in which the cleaner roller 16 is pushed into the intermediate transfer belt 43. On the contrary, the tip portion of the opposing brush 81 may be allowed to protrude slightly from the path of the intermediate transfer belt 43 so as to hold the intermediate transfer belt 43 by the tip portion of the opposing brush 81.

Furthermore, in this embodiment, semiconductive fiber in which carbon is dispersed in rayon is used as a brush for the opposing brush 81, but a material of the brush is not limited to the above-mentioned material. For example, it is also possible to use a material in which conductive material is dispersed in a fiber such as nylon or polyester etc., metal thin fiber or carbon fiber. Furthermore, the height, width and density of the brush fiber are not also limited to the above-mentioned limitation as long as such a potential in the region in which the cleaner roller 16 is pressed onto the intermediate transfer belt 43 can be kept at constant.

SECOND EMBODIMENT

Figure 7:
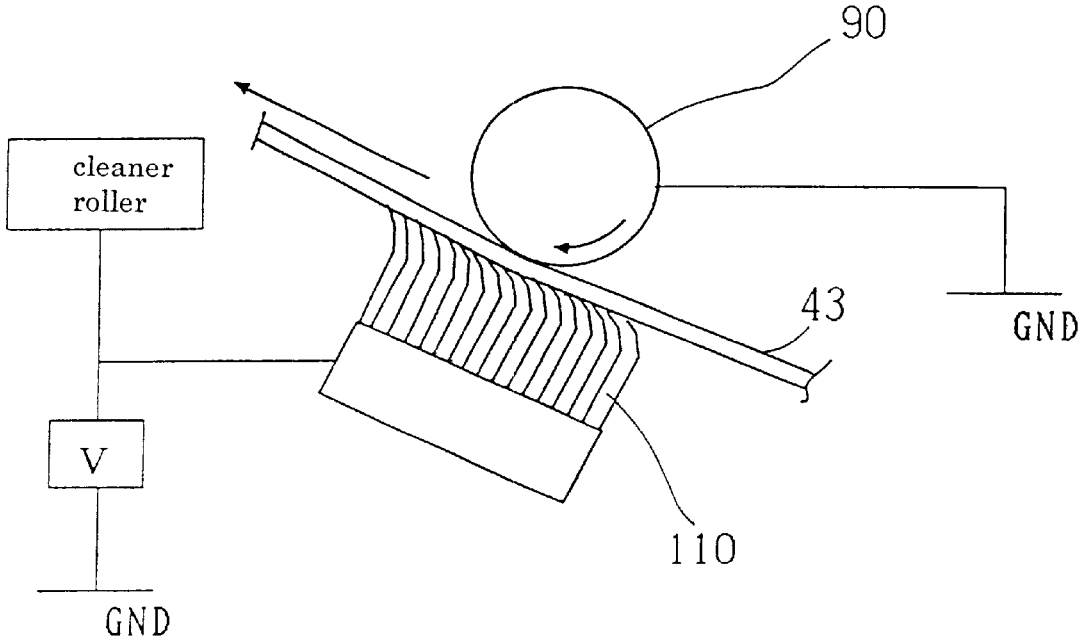
FIG. 7 is an enlarged view showing a configuration in the vicinity of a press portion of a pretreatment roller of an image forming apparatus in a second embodiment according to the present invention.
Figure 8:
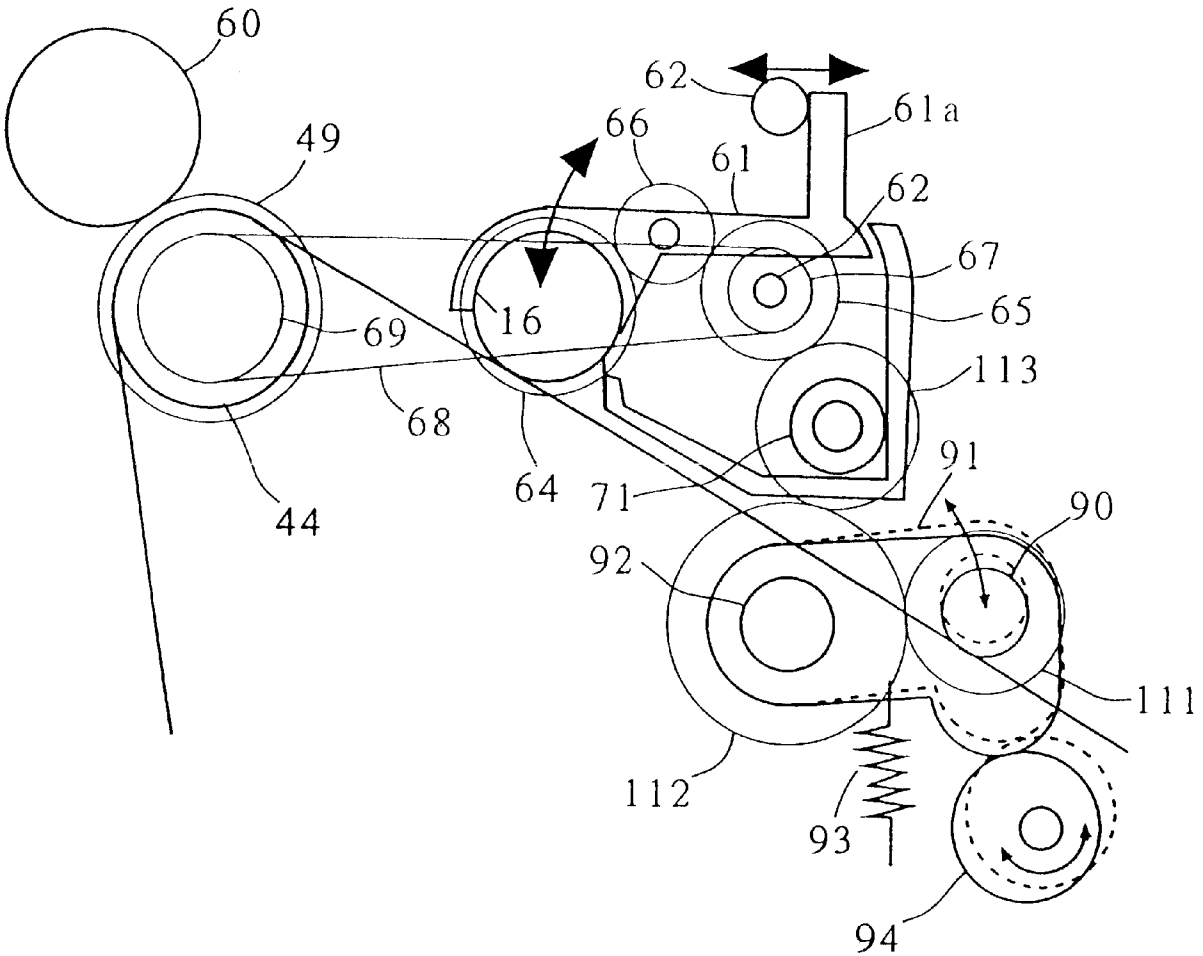
FIG. 8 is a view showing a configuration of a holder of the pretreatment roller in the second embodiment according to the present invention.

The following is an explanation of a second embodiment of an image forming apparatus according to the present invention, with reference to FIGS. 7 and 8.

FIG. 7 is an enlarged view showing a configuration in the vicinity of a press portion of a pretreatment roller of an image forming apparatus in a second embodiment according to the present invention. FIG. 8 is a view showing a configuration of a holder of the pretreatment roller 90.

As shown in FIG. 7, in this embodiment, unlike the first embodiment, an opposing brush 110 is provided facing the pretreatment roller 90 while sandwiching the intermediate transfer belt 43 between the opposing brush 110 and the pretreatment roller 90. The opposing brush 110 is made of the same material as that of the opposing brush 81 of the first embodiment. A voltage of +230V is applied to the cleaner roller 16 and electrical conduction between the opposing brush 110 and cleaner 16 is established. When the pretreatment roller 90 is pressed onto to the intermediate transfer belt 43, the pretreatment roller 90 presses onto the opposing brush 110 via the intermediate transfer belt 43. When the pretreatment roller 90 is separated from the intermediate transfer belt 43, the opposing brush 110 is only in slight contact with the intermediate transfer belt 43 and hardly affects the movement of the intermediate transfer belt 43.

As mentioned above, in this embodiment, since the opposing brush 110 is provided facing the pretreatment roller 90 while sandwiching the intermediate transfer belt 43 between the pretreatment roller 90 and the opposing brush 110, the contact pressure of the pretreatment roller 90 and toner on the intermediate transfer belt 43 can be increased. Therefore, it is possible to bring the pretreatment roller in contact with a larger amount of toner by smoothening unevenness on a toner layer and also to increase the true contact area between the pretreatment roller 90 and the toner when they are in contact with each other. As a result, since the opportunity that the pretreatment roller 90 is in contact with toner is increased, it is possible to remove a larger amount of positive charge from the surface of toner by only one touch. Therefore, it is possible to remove the waste toner on the intermediate transfer belt 43 completely with the cleaner roller 16. In particular, since the opposing electrode is formed in a brush shape, similar to the formation of the opposing brush 81 in the above-mentioned first embodiment, the load variation when the pretreatment roller 90 is separated from the opposing brush can be suppressed. Furthermore, since the pretreatment roller 90 is electrically grounded while sandwiching the intermediate transfer belt 43 between the pretreatment roller 90 and the opposing brush 110, and also since the potential of the opposing brush 110 is set at +230V, which is the same as that of the cleaner roller 16, an electric field is generated on the portion in which the pretreatment roller 90 is in contact with toner on the intermediate transfer belt 43. Since the electric field allows the positive charge to move toward the pretreatment roller 90 and move negative charge toward toner, when the pretreatment roller 90 is in contact with the toner, a larger amount of positive charge can be removed from the toner by only one touch while charging the toner negatively. Furthermore, since a plurality of members are designed to have the same potential, there is no need to provide an additional electric power source or terminals. Therefore, a simple and inexpensive apparatus can be realized.

As shown in FIG. 8, the pretreatment roller 90 is provided with a coaxial pretreatment roller gear 111. A driving force is transmitted from an arm axis gear 112 provided at an arm rotatable axis 92 of an arm 91 supporting the pretreatment roller 90 through the pretreatment roller gear 111. Therefore, even when the arm 91 separating the pretreatment roller 90 from the intermediate transfer belt 43 is rotated, the driving force can be transmitted stably from the arm axis gear 112 to the pretreatment roller 90. A driving force is transmitted to the arm axis gear 112 from the driving axis 44 by way of a driving axis pulley 69, a timing belt 68, a rotation axis pulley 67, a rotation axis gear 65, and a conveying coil gear 113. The peripheral speed of the pretreatment roller 90 is 0.5 *times as that of the intermediate transfer belt 43. The pretreatment roller 90 rotates so that it moves in the same direction at the contact surface. In this way, by differentiating the peripheral speed of the pretreatment roller 90 from that of the intermediate transfer belt 43, toner can roll by the friction force at the nip portion between the pretreatment roller 90 and the intermediate transfer belt 43. Therefore, the opportunity that the pretreatment roller 90 is in contact with toner is increased, and thus a larger amount of positive charge can be removed from the surface of toner by the pretreatment roller 90. Furthermore, the surface of the pretreatment roller 90 is subjected to the electroless plating of nickel capable of charging toner negatively. Therefore, when the pretreatment roller 90 is in contact with toner, it is possible to remove a larger amount of positive charge from the surface of toner by only one touch. As a result, since it is possible to remove a larger amount of positive charge on the surface of the toner, the waste toner on the intermediate transfer belt 43 can be removed completely. Moreover, the surface roughness Ra of the pretreatment roller 90 is* 0.3–5 μm and the surface is not subjected to a sand-blasting procedure. Thus, the pretreatment roller 90 can be produced at low price.

Other configurations and operations are the same as those in the above-mentioned first embodiment.

As mentioned above, according to this embodiment, it is possible to remove a larger amount of positive charge on the surface of toner by the pretreatment roller 90 and to put the toner in a normal polarity. Therefore, even if the cleaning voltage is low, it is possible to remove the toner on the surface of the intermediate transfer belt 43 by the cleaner belt 16 completely. In this embodiment, a voltage as low as +230V is applied to the cleaner roller 16. By setting the voltage of the cleaner roller 16 low, it is possible to suppress the load variation by the cleaner roller 16. Consequently, it is possible to suppress the positional displacement when the cleaner roller 16 is separated.

In this embodiment, the voltage of the cleaner roller 16 is set to be +230V, but there is no limitation to this voltage. It is desirable that the absolute value of the voltage of the cleaner roller 16 is 150–400V.

THIRD EMBODIMENT

Figure 9:
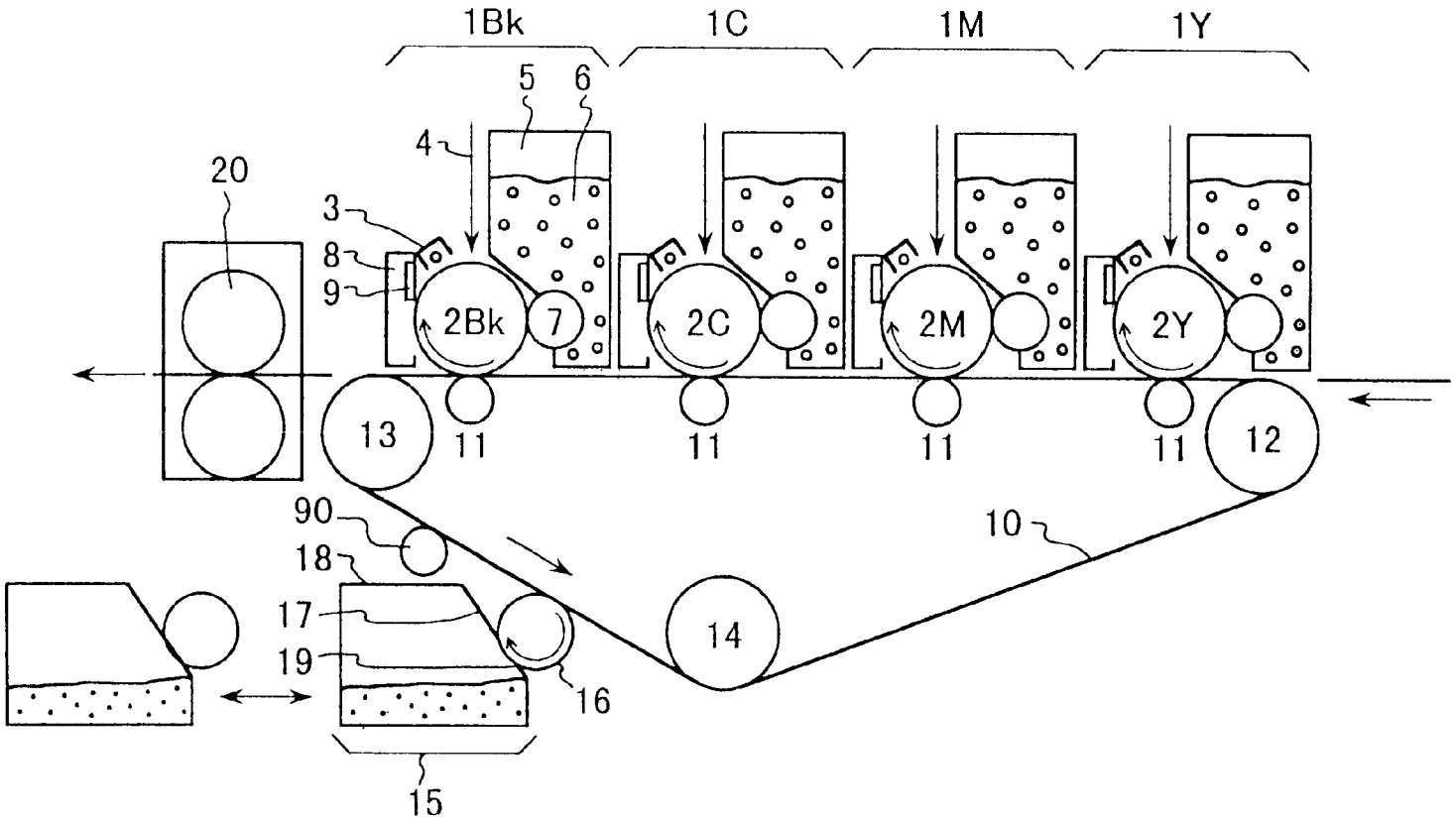
FIG. 9 is a view showing a configuration of an image forming apparatus in a third embodiment according to the present invention.
Figure 10:
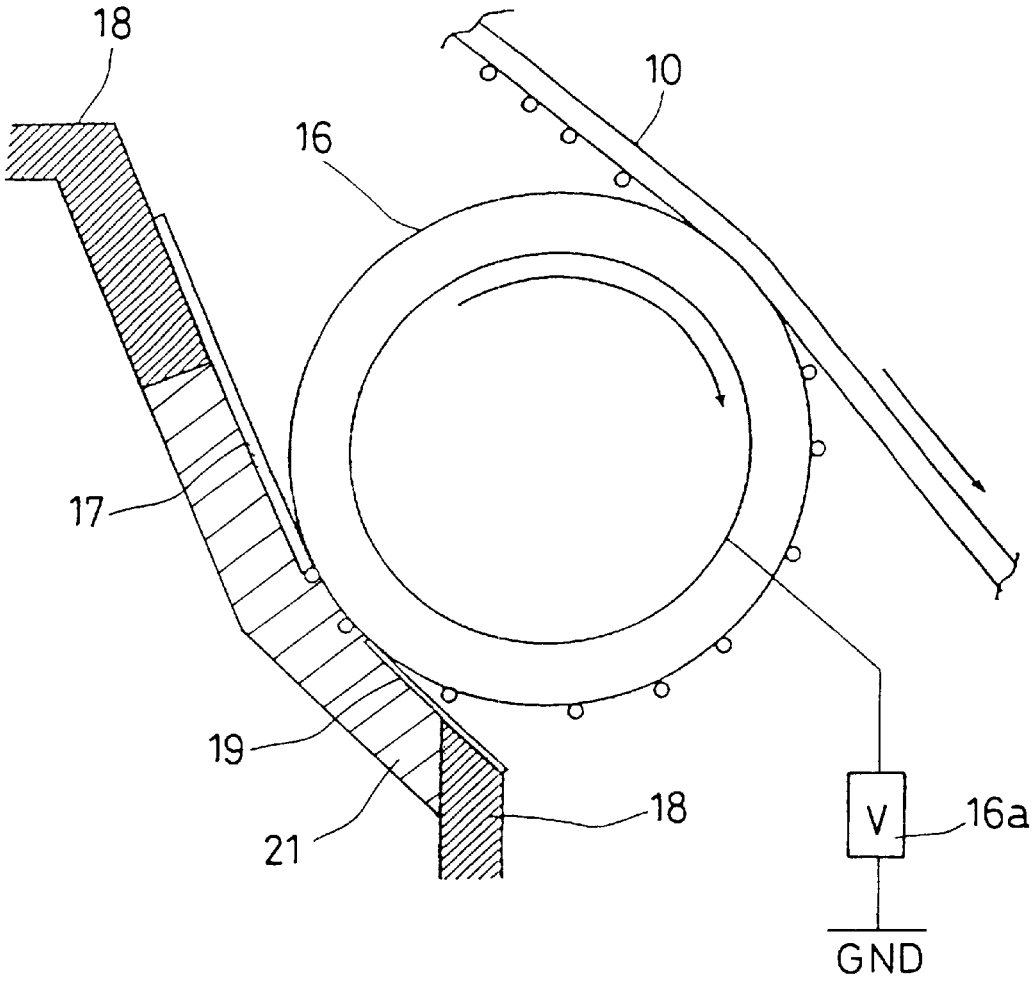
FIG. 10 is an enlarged view showing a cleaning portion in the third embodiment according to the present invention.

The following is an explanation of a third embodiment of an image forming apparatus according to the present invention, with reference to FIGS. 9 and 10. FIG. 9 is a view showing a configuration of an image forming apparatus of a third embodiment according to the present invention. FIG. 10 is an enlarged view showing a cleaning portion.

In FIG. 9, reference numeral 1 denotes an image forming unit, integrating the process elements that are arranged around each of the various photosensitive members 2 of the colors yellow (Y), magenta (M), cyan (C), and black (Bk). Each image forming unit is made of the following components. In this configuration, image forming units 1Y, 1M, 1C, and 1Bk for yellow, magenta, cyan, and yellow are arranged from the right side (the side of a paper feeder) to the left side (paper sending portion) in this order. Herein, the photosensitive member 2 is formed in a drum shape having a diameter of 30 mm and rotates at the speed of about 100 mm/sec in the arrow direction.

Reference numeral 3 denotes a corona charger for negatively charging the photosensitive member 2 homogeneously, reference numeral 4 denotes a signal light capable of writing a static latent image by scanning and exposing the photosensitive member 2 in the direction of the main line. Reference numeral 5 denotes developers, each having yellow, magenta, cyan and black toners 6 and attaching the negatively charged toner to a static latent image on the photosensitive member 2 facing a developing roller 7. The toner 6 of each color is made of polyester resin, and a pigment dispersed in the resin and has an average particle diameter of 8 μm. Reference numeral 8 denotes a cleaner for cleaning off the toner remaining on the surface of the photosensitive member 2 after the transfer. This cleaner 8 includes a cleaning blade 9 made of rubber.

Reference numeral 10 denotes a transfer belt for conveying recording paper. The transfer belt 10 is an endless belt having a thickness of about 100 μm and is made of a semiconductive polycarbonate film having, for example, a surface resistivity of $5\times10^9$ Ω/□, which is coated with a fluororesin such as PFA, PTFE, or the like. The peripheral speed of the transfer belt 10 is substantially the same as that of the photosensitive member 2. Reference numeral 11 denotes a transfer roller for providing a toner image on the photosensitive member 2 with a transfer electric field in the direction toward the recording paper side via the transfer belt 11. Hereinafter, the position in which the photosensitive member 2 faces the transfer belt 10 will be referred to as a "transfer position."

Reference numeral 12 denotes a driving roller for suspending the transfer belt 10 and rotating thereof, reference numeral 13 denotes a driven roller as a peeling means for peeling the recording paper from the transfer belt 10 by the curvature of the surface, and reference numeral 14 denotes a tension roller for providing a transfer belt 10 with tension. Each roller is made of aluminum pipe having a diameter of 30 mm. The transfer belt 10 is provided with 3 kgf of tension by the tension roller 14.

Reference numeral 15 is a cleaner unit for cleaning off toner on the surface of the transfer belt 10 and includes a cleaner roller 16, a scraper 17, a waste toner case 18, a pick-up seal 19, and a side seal (not shown) for preventing the toner from leaking out of the gap between the end portion of the cleaner roller 16 and the waste toner case 18. The cleaner unit 15 is formed by integrating these members into one unit and is attached to the apparatus main body detachably.

The cleaner roller 16 is constantly pressed onto the transfer belt 10 so that the cleaner roller 16 is pushed beyond the common tangent of the driven roller 13 and the tension roller 14 by only 1 mm (hereinafter, a portion where the cleaner roller 16 is pressed onto the transfer belt 10 respectively will be referred to as "cleaning portion"). The cleaner belt 16 and the transfer belt 10 rotate in the arrow direction so that they rotate in the same direction at their contact force. Herein, the peripheral speed of the cleaner roller 16 at this contact portion is set to be 3 times that of the transfer belt 10. Since the cleaner roller is rotated three times faster than the transfer belt 10, toner can be provided with both the electrical attraction force and mechanical shear force at the cleaning portion. Therefore, it is possible to remove the toner on the transfer belt 10 completely. There is no actual problems as long as this relative speed is in the range from 0.5 times to 0.8 times and, from 1.2 times to 4 times. When the relative speed is less than 0.5 times, the amount of the toner attached to the cleaner roller is relatively increased. Thus, it is difficult to remove the toner on the cleaner roller 16. Furthermore, when the relative speed is larger than 4 times, the friction force between the cleaner roller 16 and the scraper 17 is relatively larger. Thus, the surface of the cleaner roller may be abraded.

The cleaner roller 16 is made of an aluminum pipe having a surface of an 8 μm thick anode oxide film (alumite layer) formed by an alumite sulfate procedure. The surface roughness $R_{max}$ is 2 μm or less. The scraper 17 is made of PET (polyethylene terephthalate) having a thickness of 100 μm and is capable of wiping off toner on the cleaner roller 16 by pressing onto the surface of the cleaner roller 16. The scraper 17 tilts by only 40° with respect to the tangent of the cleaner roller 16. That is, the cleaner roller 16 presses the scraper 17 by only about 1 mm in the direction of radius thereof. Since the scraper having such a configuration is provided, toner on the cleaner roller 16 can be removed completely with an inexpensive and simple configuration.

The waste toner case 18 collects the toner scraped off by the scraper 17. The pick-up seal 19 is in contact with the cleaner roller 16 facing the scraper 17 and can prevent the toner accumulated in the waste toner case 18 from spilling to the outside from the inside without dropping the toner on the surface of the cleaner roller 16. Furthermore, since the inside of the waste toner case 18 is sealed with a seal and the cleaner roller 16, it is possible to prevent the waste toner from scattering to the outside when the cleaner unit 15 is replaced with a new one. Furthermore, since waste toner can be disposed of by replacing the cleaner unit capable of attaching /detaching, the waste toner is prevented from spilling out of the waste toner case 18. Furthermore, the spilling of toner from the gap between the end portion of the cleaner roller 16 and the waste toner case 18 can be prevented by using the side seal 21. Therefore, it is possible to keep the apparatus main body in good condition for a long time with simple maintenance.

Reference numeral 20 denotes a fixing device for fixing the toner image transferred on the recording paper.

In FIG. 9, reference numeral 90 denotes a pretreatment roller made of a conductive metal, for example, stainless steel, having a diameter of 10 mm, which is held by the intermediate transfer belt 10 detachably. The pretreatment roller 90 is in contact with only the intermediate transfer belt 10 between the cleaner roller 16 and the driven roller 13 that works as a peeling means (at the upstream side from the cleaner roller 16 in the rotation direction of the transfer belt 10). The pretreatment roller 90 is not provided with a member for scraping off toner on the surface. Herein, the holder of the pretreatment roller 90 is the same as that in the above-mentioned first embodiment (see FIG. 5).

The following is an explanation of the operation of an image forming apparatus having the above-mentioned configuration.

First, a yellow toner image is formed on the rotating photosensitive member 2Y by a coroner charger 3 for an image forming unit 1Y positioned at the right side (side of a paper feeding device), signal light beam 4 and a developer 5. The recording paper is transferred to the transfer position in timing in which the yellow toner image moves toward the transfer position. In the nip portion between the photosensitive drum 2 at the transfer position and the recording paper, the yellow toner image is transferred to the recording paper by the voltage applying to the transfer roller 11.

When an image is formed, the charger 3 charges the photosensitive member 2 at −450V. The potential of the photosensitive member 2 after exposure is −50 V. A DC voltage of −250V is applied to the developing roller 7. A DC voltage of +800V is applied to the transfer roller 11. The driving roller 12, the driven roller 13 and the tension roller 14 are electrically grounded. Furthermore, a DC power source 16a is connected to the cleaner roller 16. A DC voltage of +400V is applied to the cleaner roller 16 by this DC power source **16*a***.

Thereafter, toner images of the respective colors of magenta, cyan, and black by the image forming units 1M, 1C and 1Bk are formed by timing in which they are overlapped on the yellow toner image on the recording paper that is conveyed to the transfer belt 10.

The recording paper on which a color image of a plurality of colors is transferred is conveyed downstream by the transfer belt 10, and peeled off from the transfer belt 10 at the winding portion toward the driven roller 13 due to the stiffness of the recording paper. The recording paper peeled off from the transfer belt 10 is heated by the fixed device 20, whereby the toner image is fixed onto the recording paper.

Toners attached to the region other than the recording paper on the transfer belt 10 are partially charged with an opposite polarity by the voltage of the transfer roller 11. This toner charged with an opposite polarity is cleaned off in the following manner. First, when toner on the transfer belt 10 reaches the press portion of the pretreatment roller 90, toner is in contact with the pretreatment roller 90 and charged by the friction. As a result, toner carried to the cleaning portion returns to the normal polarity.

Furthermore, when toner that is not transferred on the surface of the transfer belt 10 reaches the cleaning portion, toner on the transfer belt 10 is removed by the mechanical friction force and the electrical attraction of the cleaner roller 16. Thereafter, toner attached to the cleaner roller 16 is scraped off by the scraper 17 and collected in the waste toner case 18.

When the toner case is filled with toner after a long time of use, the apparatus can be used further by replacing the cleaner unit 15 with a new one so as to keep it in a good condition.

The electrical resistance on the surface of the cleaner roller 16 largely affects the cleaning property. This electrical resistance is measured as the electrical resistance between the cleaner roller 16 and a conductive sheet. The conductive sheet is pressed by the cleaner roller 16, has a length of 100 mm and a thickness of 100 $\mu$m and is made of PET coated with aluminum. When this electrical resistance is set to be in the range from 10 kΩ to 1 GΩ, desirably from 500 kΩ to 100 MΩ, excellent cleaning property can be obtained. When the electrical resistance on the surface of the cleaner roller 16 is too high or too low, the cleaning property is deteriorated. The reason for this can be explained as follows. When the electrical resistance on the surface of the cleaner roller 16 is too high, negative charge from charged toner is accumulated on the surface of the cleaner roller 16. Therefore, the surface of the cleaner roller 16 has negative polarity and is electrically repulsive with respect to toner. As a result, it is not possible to remove the toner on the transfer belt 10. On the contrary, when the electrical resistance on the surface of the cleaner roller 16 is too small, positive charge is applied to the negatively charged toner from the cleaner roller 16. Therefore, the toner is charged positively and the toner becomes electrically repulsive to the cleaner roller 16. As a result, it is not possible to remove the toner on the surface of the transfer belt 10. Therefore, charges are not accumulated on the surface of the cleaner roller 16 and it is necessary to have high resistance, which does not provide the toner with charge.

According to this embodiment, since the surface of the cleaner roller 16 is subjected to an alumite procedure, a layer having a hardness and high electrical resistance can be formed inexpensively. Therefore, charges are not accumulated on the surface of the cleaner roller 16, and furthermore charges having opposite polarity to that of toner are not provided. Furthermore, the surface of the cleaner roller 16 becomes excellent in abrasion resistance property, and the shape of the roller is not deformed. Furthermore, as compared with the case where the fur brush is used, the apparatus can be formed inexpensively and in a simple configuration. Therefore, it is possible to perform cleaning operation stably for a long time with a simple configuration.

In this embodiment, the opposing electrode is not provided. However, if the opposing electrode is provided in the place facing the cleaner roller 16 or pretreatment roller 90 while sandwiching the transfer belt 10 between the cleaner roller 16 or the pretreatment roller 90 and the opposing electrode, it is possible to obtain the same effects as the first and second embodiments.

In this embodiment, the cleaner unit 15 is formed by integrating the cleaner roller 16, the scraper 17, the waste toner case 18, pick-up seal 19 and side seal into one unit and can be attached to the apparatus main body detachably. However, the above-mentioned members may be fixed to the apparatus main body. In this case, it is necessary to provide a means for carrying waste toner to the outside and collecting.

FOURTH EMBODIMENT

Figure 11:
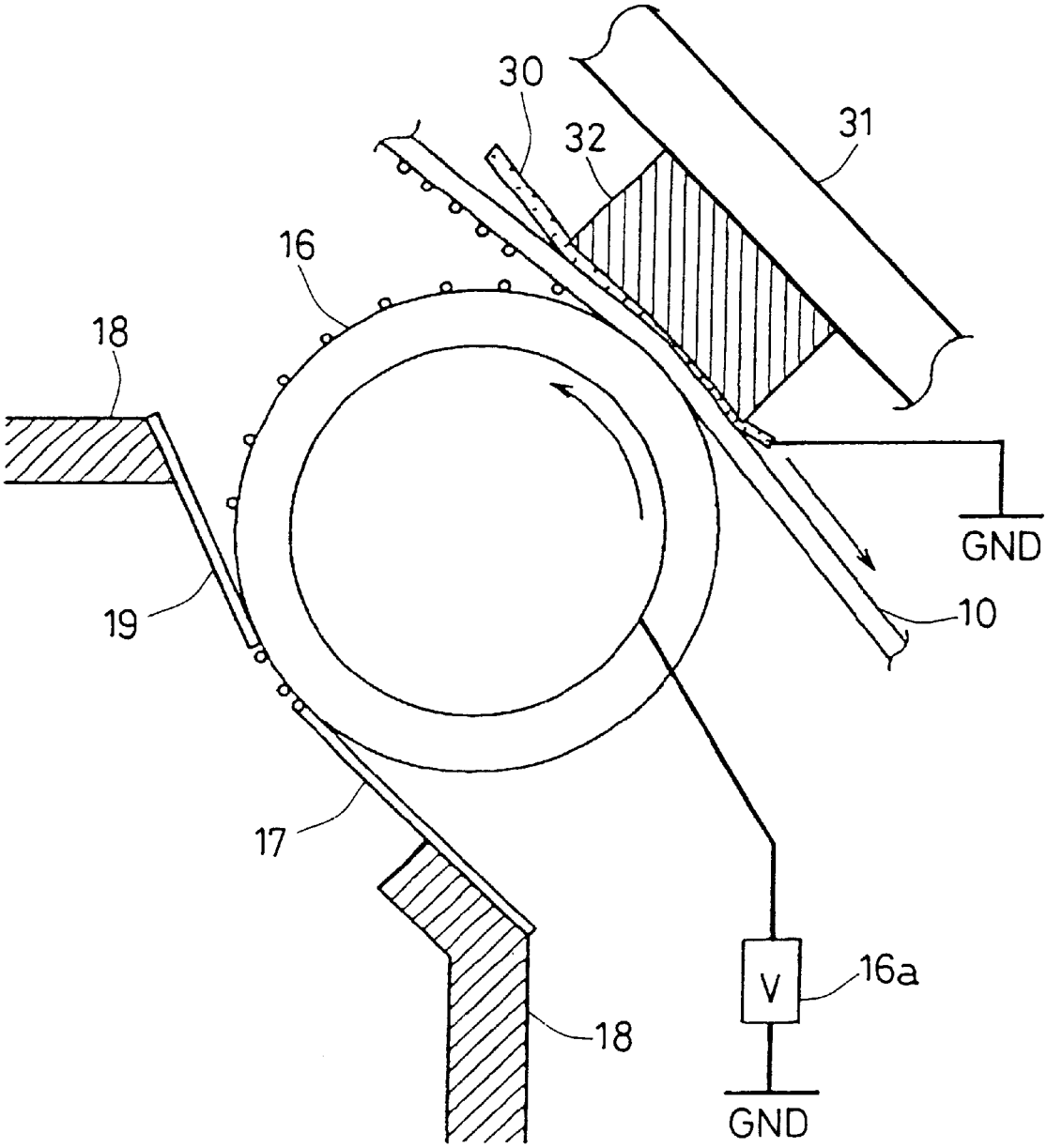
FIG. 11 is an enlarged view showing a cleaning portion in a fourth embodiment according to the present invention.
Figure 12:
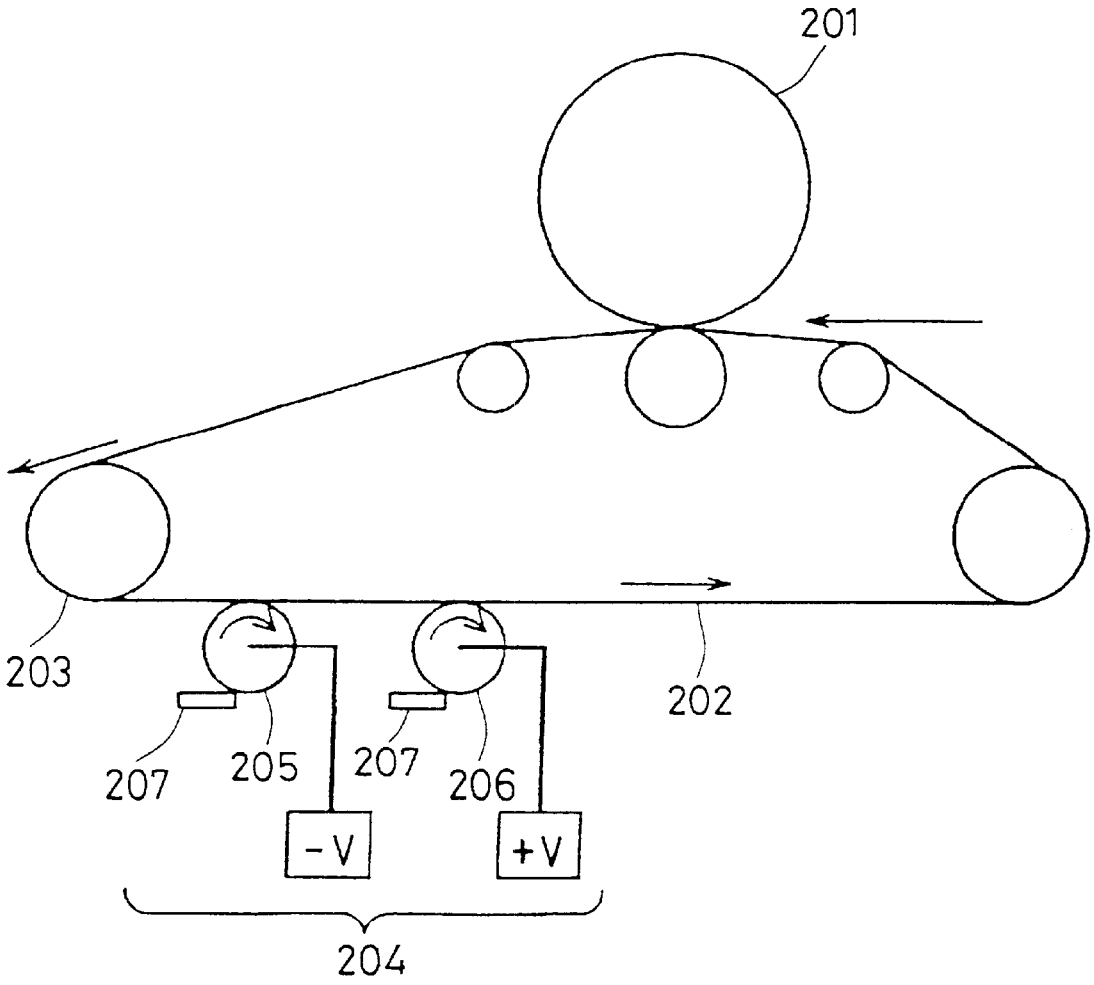
FIG. 12 (PRIOR ART)
FIG. 12 is a side cross-sectional view showing an image forming apparatus a prior art.
Figure 13:
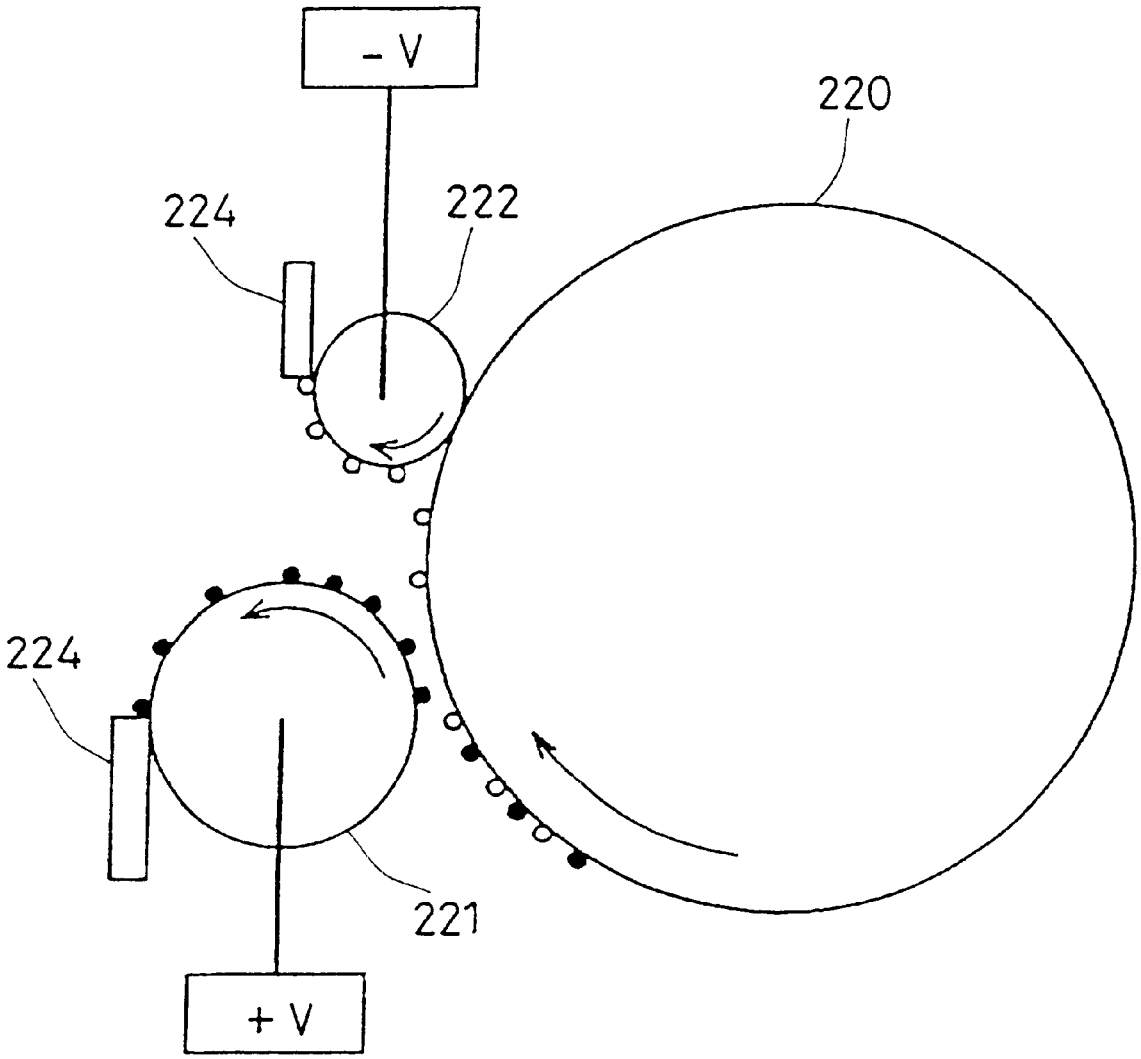
FIG. 13 (PRIOR ART)
FIG. 13 is a side cross-sectional view showing another image forming apparatus of a prior art.

The following is an explanation of a fourth embodiment of an image forming apparatus according to the present invention, with reference to FIG. 11. FIG. 11 is an enlarged view showing a cleaning portion of a fourth embodiment according to the present invention.

As shown in FIG. 11, in this embodiment, unlike the third embodiment, an opposing electrode sheet 30 is provided facing the cleaner roller 16 while sandwiching the transfer belt 10 between the opposing electrode sheet 30 and the cleaner roller 16. Herein, the opposing electrode sheet 30.is made of a conductive sheet and electrically grounded. A flexible backup member 32 is pressed onto the opposing electrode sheet 30. The backup member 32 is supported by a supporting member 31. Furthermore, the alumite layer of the surface of the cleaner roller 16 is impregnated with Teflon. The surface roughness $R_{max}$ of the cleaner roller 16 is 5 $\mu$m or less. The scraper 17 is made of a stainless thin plate having a thickness of 50 $\mu$m and the free end length of 6 mm. Furthermore, the cleaner belt 16 and transfer belt 10 rotate in the arrow direction so that they rotate in the opposite direction at their contact portion. Herein, at this contact portion, the peripheral speed of the cleaner roller 16 is set to be as the same as that of the transfer belt 10. Furthermore, the voltage applied to the cleaner roller 16 is set at +350V.

The opposing electrode sheet 30 arranged at the rear surface of the transfer belt 10 is made of conductive resin sheet electrically grounded and having a thickness of about 30 $\mu$m, in which carbon is dispersed in the resin of a high lubricity, for example, Teflon. The backup member 32 is a flexible sponge-like member and is pressed onto the opposing electrode sheet 30 at the position corresponding to the portion at which the cleaner roller 16 is pressed onto the transfer belt 10. The opposite electrode sheet 30 is attracted by the backup member 32 and presses the transfer belt 10 to the cleaner roller 16. At this time, the backup member 32 is deformed in accordance with the amount of the cleaner roller 16 pushing onto the transfer belt 10.

Other configurations and operations are the same as those of the above-mentioned third embodiment.

According to this embodiment, by resiliently pressing the flexible sheet-like opposing electrode 30 onto the transfer belt 10 by the flexible backup member 32, the transfer belt 10 can be pressed onto the cleaner roller 16 over the whole region in which the cleaner roller 16 is pushed. Therefore, if there is distortion or deformation in the transfer belt 10, it is possible to obtain a stable cleaning nip. Consequently, since it is possible to secure the friction force and electrical field force applied to the toner on the transfer belt 10, the waste toner can be removed stably and completely.

By providing the opposing electrode sheet 30 facing the cleaner roller 16 while sandwiching the transfer belt 10 between the cleaner roller 16 and the opposing electrode sheet 30, all over the cleaning nip of the cleaner roller 16 and the transfer belt 10, it is possible to form stably the cleaning electric field in the direction in which the toner is attracted toward the cleaner roller 16. If the opposing electrode is not provided, the cleaning electric field is deteriorated by charges generated on the surface of the transfer belt 10 due to the peeling of the recording paper, the application of voltage at the time of transfer, and friction with the cleaning roller 16. Thus, the cleaning performance is lowered. Therefore, it was necessary to set the cleaning voltage high. In this embodiment, it is possible to form the cleaning electric field stably, and the cleaning property of the toner on the surface of the transfer belt 10 is improved. As a result, even if the cleaning voltage is set to be low, it is possible to remove the waste toner completely and stably.

Furthermore, since the backup member 32 is fixed and does not rotate, it is not necessary to provide a bearing or to form the backup member in a roller shape, and therefore, it can be fabricated with a simple structure at low cost.

Furthermore, since the scraper 17 is formed of a stainless steel thin plate having a thickness of 50 $\mu$m, it is possible to enhance the abrasion resistance of the scraper 17. Consequently, it is possible to prevent the defective scraping of toner due to the faults or gaps at the tip of the scraper 17. Therefore, it is possible to remove toner on the cleaner roller 16 for a long time stably and completely. As a result, the increased lifetime of the transfer belt unit 42 and reduced maintenance can be attained. The cost per recording paper can be reduced and at the same time, the apparatus can be used more easily. Furthermore, by forming the scraper 17 with a stainless steel plate having a thickness of 50 $\mu$m, the pressing force of the tip of the scraper 17 is improved. Therefore, if the surface roughness $R_{max}$ is 0.5 $\mu$m or more and 8 $\mu$m or less, the scraper can scrape off the toner on the cleaner roller 16 for a long time. Therefore, it is possible to reduce the cost required for the surface finish or the like. It is desirable that the surface roughness of the cleaner roller 16 is as small as possible, however, from a practical standpoint, the surface roughness $R_{max}$ may be 0.5 $\mu$m or more from the view point of the productivity.

The scraper 17 can scrape off the toner on the cleaner roller 16 stably as long as the free end length ranges from 4 mm to 8 mm, and thickness ranges from 30 $\mu$m to 80 $\mu$m. Examples of a material for the scraper 17 include, besides a thin plate made of phosphor bronze or stainless steel, a spring material having a high hardness, for example, SUS301CSP, SUS304CSP, or the like.

Furthermore, since the surface of the cleaner roller 16 is impregnated with Teflon as a lubricant, the frictional coefficient between the cleaner roller 16 and the scraper 17 is reduced. Therefore, the abrasion of the scraper 17 can be reduced. Furthermore, since the power of the cleaner roller 16 of carrying toner is reduced, thus the toner on the cleaner roller 16 can be scraped off easily. Therefore, it is possible to scrape off the toner on the surface of the cleaner roller 16 by using the scraper 17 for a long time. Consequently, the increased lifetime of the cleaner unit 15 and reduced maintenance can be attained.

By setting the rotation directions of the cleaner roller 16 and the transfer belt 10 opposite at their contact surface, it is possible to provide the toner with a mechanical shear force at the cleaning portion without increasing the peripheral speed. Therefore, it is possible to improve the performance of removing toner on the transfer belt 10 while controlling the power of the cleaner roller 16. Furthermore, since the speed in which the cleaner roller 16 and the scraper 17 are in contact and scrapes with each other is lowered, it is possible to scrape off the toner on the cleaner roller 16 by the scraper 17 for a long time. Consequently, the increased lifetime of the cleaner unit 15 and reduced maintenance can be attained.

If the cleaner roller 16 has a high hardness like a metal, the reaction force is increased when the cleaner roller 16 is pressed onto the hard backup member like a plate. Therefore, the friction force between the transfer belt 10 and the cleaner roller 16 and the backup member is increased, and the load variation easily can be too high. Therefore, if the cleaner roller 16 is made of metal, the great effect can be obtained when the flexible opposing electrode member is used as a opposing electrode as in the present invention.

In this embodiment, the conductive resin sheet is used for the opposing electrode sheet 30, but there is no necessary limitation to this configuration, and thin metal sheet or an elastic sheet coated with conductive materials also can be used. A material of this opposing electrode sheet 30 is not particularly limited as long as the material has a flexibility, which is changing its shape along the inner face of the transfer belt 10 by the elastic pressing power of the backup member 32 when the cleaner roller 16 is pressed onto the transfer belt 10, and the surface resistivity of $1\times10^6$ Ω/□ or less. This surface resistivity is measured as an electrical resistance between an aluminum roller and the opposing electrode sheet 30 when the aluminum roller that has a same shape as the cleaner roller 16 and that is not subjected to the alumite process is procedure is pressed onto the backup member 32 without having a transfer belt 10. Furthermore, it is desirable that the opposing electrode sheet 30 is made of a material having both lubricity and the abrasion resistance because it slides on the inner face of the transfer belt 10.

In the above-mentioned embodiment, the cleaner member is formed in a roller shape, but there is no limitation to this configuration, and the same effect can be obtained if aluminum belt whose surface is subjected to the alumite procedure and suspended on the rotating supporting axis is used.

Furthermore, in the above-mentioned embodiment, aluminum treated with alumite sulfate is used for the material for the cleaner roller 16, but there is no limitation to this configuration, and aluminum that is subjected to an anode oxidation treatment with nitric acid or other nitrating acid can be used. Moreover, the material is not necessarily limited to aluminum, but other metal on which the anode oxide film is formed can be used as long as the metal has an equal electrical resistance and hardness. For the cleaner roller 16, the metal roller whose surface is subjected to an alumite procedure is used, but there is no limitation to this, and it is also possible to use a metal having the equal resistance, for example, metal coated with semiconductive resin tube, or a metal coated thinly with a semiconductive resin can be used as a cleaner roller.

Furthermore, in the above-mentioned embodiment, the pretreatment roller 90 and the opposing brush 81 are electrically grounded so as to have the same potential, so that the cleaner roller 16 and the opposing brush 110 have the same potential. However, the same effect can be obtained even if the potentials are different from each other as long as the direction of the electric field in the thickness direction of the cleaner roller 16 and the intermediate transfer belt 43 is the same as that of the above-mentioned first and second embodiments.

Moreover, in the above-mentioned embodiments, as materials for the intermediate transfer belt 43 and the transfer belt 10, semiconductive polycarbonate having a surface resistivity of $1\times10^9$ Ω/□ and a volume resistivity of $1\times10^9$ Ω·cm is used. The materials are not necessarily limited to the above-mentioned materials, and other materials such as polyimide, polyethylene terephthalate, or the like, can be used for the intermediate transfer belt or transfer belt as long as the materials have the same resistance value. The surface resistivity of the intermediate transfer belt or the transfer belt ranges from $1\times10^8$ Ω/□ to $1\times10^{10}$ Ω/□ for the surface resistivity and the volume resistivity ranges from $1\times10^8$ Ω·cm to $1\times10^{10}$ Ω·cm. When the flexible material such as resin is used, too high pressure is not applied to the cleaning portion. Therefore, it is possible to prevent the surface of the intermediate transfer belt or transfer belt and the cleaner roller from being damaged.

Moreover, in the above-mentioned embodiment, an image forming apparatus for forming a color image by using a plurality of image forming units is explained as an example, but there is no limitation to this configuration. However, the present invention can be applied to a monochrome image forming apparatus for forming a monochrome image. Furthermore, if a scanner or facsimile module are provided, the present invention also can be applied to a copier or a facsimile.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An image forming apparatus comprising:

a toner supporting member that moves with charged toner supported on a surface thereof;

a cleaner member that is rotated while being pressed onto said toner supporting member;

a potential supplying means for supplying a potential for electrically attracting said toner from said toner supporting member to said cleaner member; and a frictionally charging member that is pressed onto said toner supporting member upstream from said cleaner member in the moving direction of said toner supporting member;

wherein said toner supporting member is an intermediate transfer belt, comprising a toner image forming means for forming a toner image charged with a predetermined polarity on said intermediate transfer belt, and a transfer means for transferring said toner image from said intermediate transfer belt onto a recording paper;

said transfer means is a transfer roller to which a voltage is applied while switching between a voltage with a polarity opposite to a charging polarity of said toner and a voltage with a polarity the same as the charging polarity of said toner, the voltage having the same polarity as the charging polarity of said toner is applied to said transfer roller, then the voltage having a polarity opposite to the charging polarity of said toner is applied while allowing said frictionally charging member to be rotated at least once; and said cleaner member is pressed onto said intermediate transfer belt between said transfer means and said toner image forming means, and said frictionally charging member is positioned between said transfer means and said cleaner member, said frictionally charging member being a rotatable roller.

2. An image forming apparatus comprising:

a toner supporting member that moves with charged toner supported on a surface thereof;

a cleaner member that is rotated while being pressed onto said toner supporting member;

a potential supplying means for supplying a potential for electrically attracting said toner from said toner supporting member to said cleaner member; and a frictionally charging member that is pressed onto said toner supporting member upstream from said cleaner member in the moving direction of said toner supporting member;

wherein said frictionally charging member is electrically grounded.

3. The image forming apparatus according to claim 2, wherein said cleaner member is an aluminum roller having an alumite layer on the surface thereof, comprising a scraper for removing said toner while being pressed onto the surface of said cleaner member.

4. An image forming apparatus comprising:

a toner supporting member that moves with charged toner supported on a surface thereof;

a cleaner member that is rotated while being pressed onto said toner supporting member;

a potential supplying means for supplying a potential for electrically attracting said toner from said toner supporting member to said cleaner member; and a frictionally charging member that is pressed onto said toner supporting member upstream from said cleaner member in the moving direction of said toner supporting member;

wherein said frictionally charging member is a rotatable roller that is in contact only with said toner supporting member, and said frictionally charging member and said toner supporting member move at different speeds from each other at the contact portion therebetween.

5. The image forming apparatus according to claim 4, wherein said frictionally charging member is a rotatable roller that is in contact only with said toner supporting member, and said frictionally charging member and said toner supporting member move in the same direction at the contact portion therebetween.

6. An image forming apparatus comprising:

a toner supporting member that moves with charged toner supported on a surface thereof;

a cleaner member that is rotated while being pressed onto said toner supporting member;

a potential supplying means for supplying a potential for electrically attracting said toner from said toner supporting member to said cleaner member; and a frictionally charging member that is pressed onto said toner supporting member upstream from said cleaner member in the moving direction of said toner supporting member;

wherein said frictionally charging member is separable from said toner supporting member, and a driving force is transmitted from a driving portion of said toner supporting member to said frictionally charging member.

7. An image forming apparatus comprising:

a toner supporting member that moves with charged toner supported on a surface thereof;

a cleaner member that is rotated while being pressed onto said toner supporting member;

a potential supplying means for supplying a potential for electrically attracting said toner from said toner supporting member to said cleaner member; and a frictionally charging member that is pressed onto said toner supporting member upstream from said cleaner member in the moving direction of said toner supporting member;

wherein an opposing electrode is provided at a position facing said frictionally charging member while sandwiching said toner supporting member between said opposing electrode and said frictionally charging member.

8. The image forming apparatus according to claim 7, wherein said frictionally charging member is electrically grounded, and said opposing electrode and said cleaner member have the same potential.

9. The image forming apparatus according to claim 7, wherein said opposing electrode is made of a conductive brush.

10. An image forming apparatus comprising:

a toner supporting member that moves with charged toner supported on a surface thereof;

a cleaner member that is rotated while being pressed onto said toner supporting member;

a potential supplying means for supplying a potential for electrically attracting said toner from said toner supporting member to said cleaner member; and a frictionally charging member that is pressed onto said toner supporting member upstream from said cleaner member in the moving direction of said toner supporting member;

wherein said frictionally charging member is a rotatable roller having a surface roughness Ra of 5–20 $\mu$m.

11. The image forming apparatus according to claim 10, wherein the surface of said frictionally charging member is subjected to sand-blasting procedure.

12. A transfer belt unit comprising, as an integrated unit:

a high resistance intermediate transfer belt which is supported rotatably, and on which toner charged with a predetermined polarity is transferred to a toner image by primary transfer, and further said toner image is transferred onto a recording paper by secondary transfer;

a cleaner roller which is pressed onto said intermediate transfer belt downstream from said secondary transfer position in the rotation direction of said intermediate transfer belt and to which a voltage with a polarity opposite to said predetermined polarity of said toner is applied; and a frictionally charging member that is pressed onto said intermediate transfer belt between said secondary transfer position and said cleaner roller;

wherein said integrated unit can be detachably attached to a main body of an image forming apparatus; and said frictionally charging member is electrically grounded.

13. The transfer belt unit according to claim 12, wherein the surface of said frictionally charging member has a charging polarity opposite to the charging polarity of said toner.

14. The transfer belt unit according to claim 12, wherein said frictionally charging member is a rotatable roller that is in contact only with said toner supporting member, and said frictionally charging member and said toner supporting member move at different speeds from each other at the contact portion therebetween.

15. The transfer belt unit according to claim 12, comprising a driving axis for rotating said intermediate transfer belt by suspending said intermediate transfer belt, a disjunction means for separating said frictionally charging member from said intermediate transfer belt, and a driving force transmitting means for transmitting a driving force from said driving axis to said frictionally charging member.

16. The transfer belt unit according to claim 12, wherein said cleaner roller is an aluminum roller having an alumite layer on the surface thereof, comprising a scraper for removing said toner while being pressed onto the surface of said cleaner roller.

17. A transfer belt unit comprising, as an integrated unit:

a high resistance intermediate transfer belt which is supported rotatably, and on which toner charged with a predetermined polarity is transferred to a toner image by primary transfer, and further said toner image is transferred onto a recording paper by secondary transfer;

a cleaner roller which is pressed onto said intermediate transfer belt downstream from said secondary transfer position in the rotation direction of said intermediate transfer belt and to which a voltage with a polarity opposite to said predetermined polarity of said toner is applied; and a frictionally charging member that is pressed onto said intermediate transfer belt between said secondary transfer position and said cleaner roller;

wherein said integrated unit can be detachably attached to a main body of an image forming apparatus;

said frictionally charging member is a rotatable roller that is in contact only with said toner supporting member, and said frictionally charging member and said toner supporting member move at different speeds from each other at the contact portion therebetween; and said frictionally charging member is a rotatable roller that is in contact only with said toner supporting member, and said frictionally charging member and said toner supporting member move in the same direction at the contact portion therebetween.

18. A transfer belt unit comprising, as an integrated unit:

a high resistance intermediate transfer belt which is supported rotatably, and on which toner charged with a predetermined polarity is transferred to a toner image by primary transfer, and further said toner image is transferred onto a recording paper by secondary transfer;

a cleaner roller which is pressed onto said intermediate transfer belt downstream from said secondary transfer position in the rotation direction of said intermediate transfer belt and to which a voltage with a polarity opposite to said predetermined polarity of said toner is applied; and a frictionally charging member that is pressed onto said intermediate transfer belt between said secondary transfer position and said cleaner roller;

wherein said integrated unit can be detachably attached to a main body of an image forming apparatus; and an opposing electrode is provided at a position facing said frictionally charging member while sandwiching said intermediate transfer belt between said opposing electrode and said frictionally charging member.

19. The transfer belt unit according to claim 18, wherein said opposing electrode and said cleaner roller have the same potential.

20. A transfer belt unit comprising, as an integrated unit:

a high resistance intermediate transfer belt which is supported rotatably, and on which toner charged with a predetermined polarity is transferred to a toner image by primary transfer, and further said toner image is transferred onto a recording paper by secondary transfer;

a cleaner roller which is pressed onto said intermediate transfer belt downstream from said secondary transfer position in the rotation direction of said intermediate transfer belt and to which a voltage with a polarity opposite to said predetermined polarity of said toner is applied; and a frictionally charging member that is pressed onto said intermediate transfer belt between said secondary transfer position and said cleaner roller;

wherein said integrated unit can be detachably attached to a main body of an image forming apparatus; and said frictionally charging member is a rotatable roller having a surface roughness Ra of 5–20 $\mu$m.

21. The transfer belt unit according to claim 20, wherein the surface of said frictionally charging member is subjected to a sand-blasting procedure.

22. An image forming apparatus comprising:

a toner supporting member that moves with charged toner supported on the surface thereof;

a cleaner member that is rotated while being pressed onto said toner supporting member; and a potential supplying means for supplying potential for electrically attracting said toner from said toner supporting member to said cleaner member;

wherein said cleaner member is made of metal and has a high-resistance layer on the surface thereof; and said toner supporting member is an intermediate transfer belt, comprising a toner image forming means for forming a toner image charged with a predetermined polarity on said intermediate transfer belt, and a transfer means for transferring said toner image from said intermediate transfer belt onto a recording paper, wherein said cleaner member is pressed onto said intermediate transfer belt between said transfer means and said toner image forming means;

said apparatus further comprising a conductive pretreatment member that is electrically grounded and is pressed onto said intermediate transfer belt between said transfer means and said cleaner member.

23. The image forming apparatus according to claim 22, wherein said pretreatment member is a rotatable roller that is in contact only with said intermediate transfer belt, and said pretreatment member and said intermediate transfer belt move at different speeds from each other at the contact portion therebetween.

24. The image forming apparatus according to claim 22, wherein said pretreatment member is a rotatable roller that is in contact only with said intermediate transfer belt, and said pretreatment member and said intermediate transfer belt move in the same direction at the contact portion therebetween.

25. The image forming apparatus according to claim 22, wherein a second opposing electrode is provided at a position facing said pretreatment member while sandwiching said intermediate transfer belt between said second opposing electrode and said pretreatment member.

26. The image forming apparatus according to claim 25, wherein said second opposing electrode and said cleaner member have the same potential.

27. An image forming apparatus comprising:

a toner supporting member that moves with charged toner supported on the surface thereof;

a cleaner member that is rotated while being pressed onto said toner supporting member; and a potential supplying means for supplying potential for electrically attracting said toner from said toner supporting member to said cleaner member;

wherein said cleaner member is made of metal and has a high-resistance layer on the surface thereof; and said toner supporting member is a transfer belt for conveying a recording paper, comprising a toner image forming means for forming a toner image charged with a predetermined polarity on said recording paper, a peeling means for peeling said recording paper from said transfer belt, wherein said cleaner member is pressed onto said transfer belt between said peeling means and said toner image forming means;

said apparatus further comprising a conductive pretreatment member that is electrically grounded and is pressed onto said transfer belt between said peeling means and said cleaner member.

28. The image forming apparatus according to claim 27, wherein a second opposing electrode is provided at a position facing said pretreatment member while sandwiching said transfer belt between said second opposing electrode and said pretreatment member.

29. An image forming apparatus comprising:

a toner supporting member that moves with charged toner supported on the surface thereof;

a cleaner member that is rotated while being pressed onto said toner supporting member; and a potential supplying means for supplying potential for electrically attracting said toner from said toner supporting member to said cleaner member;

wherein said cleaner member is made of metal and has a high-resistance layer on the surface thereof;

wherein said toner supporting member is an intermediate transfer belt, comprising a toner image forming means for forming a toner image charged with a predetermined polarity on said intermediate transfer belt, and a transfer means for transferring said toner image from said intermediate transfer belt onto a recording paper, wherein said cleaner member is pressed onto said intermediate transfer belt between said transfer means and said toner image forming means;

said apparatus further comprising a pretreatment roller that is electrically grounded and which is pressed onto said intermediate transfer belt between said transfer means and said cleaner member, and a pretreatment roller disjunction mechanism for separating said pretreatment roller from said intermediate transfer belt.

30. The image forming apparatus according to claim 29, wherein a second conductive brush having the same potential as that of said cleaner member is provided at a position facing said pretreatment roller while sandwiching said intermediate transfer belt between said second conductive brush and said pretreatment roller.

31. The image forming apparatus according to claim 30, wherein an absolute value of the voltage applied to the cleaner member is 150–400V.

32. A transfer belt unit comprising, as an integrated unit:

an intermediate transfer belt which is supported rotatably, and on which toner charged with a predetermined polarity is transferred to a toner image by primary transfer, and further said toner image is transferred onto a recording paper by secondary transfer;

a cleaner roller made of metal and having a high resistance layer on the surface thereof, which is rotated while being pressed onto said intermediate transfer belt at the downstream from said secondary transfer position in the rotation direction of said intermediate transfer belt;

a potential supplying means for supplying a potential for electrically attracting said toner to said cleaner roller; and a scraper for scraping off said toner while being pressed onto the surface of said cleaner roller;

wherein said integrated unit can be attached to a main body of an image forming apparatus detachably;

said transfer belt unit further comprising a conductive pretreatment member that is electrically grounded and is pressed onto said intermediate transfer belt between said secondary transfer position and said cleaner roller.

33. The transfer belt unit according to claim 32, wherein said pretreatment member is a rotatable roller that is in contact only with said intermediate transfer belt, and said pretreatment member and said intermediate transfer belt move at different speeds from each other at the contact portion therebetween.

34. The transfer belt unit according to claim 32, wherein said pretreatment member is a rotatable roller that is in contact only with said intermediate transfer belt, and said pretreatment member and said intermediate transfer belt move in the same direction at the contact portion therebetween.

35. The transfer belt unit according to claim 32, wherein a second opposing electrode is provided at a position facing said pretreatment member while sandwiching said intermediate transfer belt between said second opposing electrode and said pretreatment member.

36. The transfer belt unit according to claim 35, wherein said second opposing electrode and said cleaner roller have the same potential.

37. The transfer belt unit according to claim 32, wherein said cleaner roller is separable from said intermediate transfer belt.

38. The transfer belt unit according to claim 37, wherein a first conductive brush that is electrically grounded is provided at a position facing said cleaner roller while sandwiching said intermediate transfer belt between said first conductive brush and said cleaner roller.

39. The transfer belt unit according to claim 37, comprising a pretreatment roller that is electrically grounded and is pressed onto said intermediate transfer belt between said secondary transfer position and said cleaner roller, and a pretreatment roller disjunction mechanism of separating said pretreatment roller from said intermediate transfer belt.

40. The transfer belt unit according to claim 39, wherein a second conductive brush having the same potential as that of said cleaner roller at a position facing said pretreatment roller while sandwiching said intermediate transfer belt between said second conductive brush and said pretreatment roller.

* * * * *